US009121205B2

(12) United States Patent
Muramatsu et al.

(10) Patent No.: US 9,121,205 B2
(45) **Date of Patent: *Sep. 1, 2015**

(54) VEHICLE DOOR FIXING APPARATUS

(75) Inventors: Akira Muramatsu, Chiryu (JP); Kosuke Tsukamoto, Chiryu (JP); Yoshiki Odaka, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 310 days.

This patent is subject to a terminal disclaimer.

(21) Appl. No.: 13/592,935

(22) Filed: Aug. 23, 2012

(65) Prior Publication Data

US 2013/0047373 A1 Feb. 28, 2013

(30) Foreign Application Priority Data

Aug. 25, 2011 (JP) ..... 2011-184015

(51) Int. Cl.
*E05B 15/02* (2006.01)
*E05B 85/04* (2014.01)
*E05B 77/36* (2014.01)

(52) U.S. Cl.
CPC ..... *E05B 85/045* (2013.01); *E05B 77/36* (2013.01); *E05B 15/022* (2013.01); *Y10T 16/61* (2013.01)

(58) Field of Classification Search
CPC .... E05C 17/54; E05C 15/022; E05C 15/0205
USPC ..... 292/340, 341.11, 341.14, 342, 343; 16/82, 86 B
See application file for complete search history.

(56) References Cited

U.S. PATENT DOCUMENTS

| | | | | | |
|---|---|---|---|---|---|
| 1,888,829 | A * | 11/1932 | Moore | ..... | 16/85 |
| 1,903,365 | A * | 4/1933 | Haskins et al. | ..... | 16/86 B |
| 4,317,588 | A * | 3/1982 | Marchal et al. | ..... | 292/341.14 |
| 4,602,813 | A * | 7/1986 | Gergoe et al. | ..... | 292/340 |
| 5,494,324 | A * | 2/1996 | Kleefeldt | ..... | 292/340 |
| 5,992,927 | A * | 11/1999 | Scroggie | ..... | 296/207 |
| 6,676,201 | B2 * | 1/2004 | Im et al. | ..... | 296/207 |

(Continued)

FOREIGN PATENT DOCUMENTS

| | | | | |
|---|---|---|---|---|
| EP | 314075 A1 * | 5/1989 | ..... | E05B 65/19 |
| JP | S62-146861 U | 9/1987 | | |

(Continued)

OTHER PUBLICATIONS

Office Action issued by the Japan Patent Office on Jul. 7, 2015 in corresponding Japanese Application No. 2011-184015, and English language translation of Office Action (6 pages).

*Primary Examiner* — Carlos Lugo
(74) *Attorney, Agent, or Firm* — Buchanan Ingersoll & Rooney PC

(57) ABSTRACT

A vehicle door fixing apparatus includes a fixed wedge configured to be provided at one of a vehicle body panel and a door panel, and a movable wedge configured to be provided at the other one of the vehicle body panel and the door panel, wherein the movable wedge is configured to be assembled together with a base plate of a door lock striker or with a door lock assembly that is engageable with a shaft of the door lock striker, the movable wedge includes a strength member, the movable wedge includes a contact member fixedly attached to the strength member and configured to be in pressure contact with the fixed wedge, and the strength member includes a rigidity that is higher than a rigidity of the contact member.

18 Claims, 16 Drawing Sheets

(56) References Cited

U.S. PATENT DOCUMENTS

| | | | | |
|---|---|---|---|---|
| 7,014,258 | B2 * | 3/2006 | Schubring et al. | 296/207 |
| 7,029,043 | B2 * | 4/2006 | Fisher | 292/341.13 |
| 7,308,731 | B2 * | 12/2007 | Schubring et al. | 16/86 R |
| 7,681,281 | B2 * | 3/2010 | Schubring et al. | 16/86 B |
| 7,730,580 | B2 * | 6/2010 | Mokashi et al. | 16/86 R |
| 8,322,762 | B2 * | 12/2012 | Watson | 292/343 |
| 2002/0000727 | A1 * | 1/2002 | Rass et al. | 292/216 |
| 2006/0244286 | A1 * | 11/2006 | Meyers et al. | 296/146.1 |
| 2010/0219648 | A1 | 9/2010 | Watson | |
| 2012/0112474 | A1 | 5/2012 | Muramatsu et al. | |
| 2012/0112477 | A1 | 5/2012 | Muramatsu et al. | |
| 2012/0161454 | A1 | 6/2012 | Muramatsu et al. | |

FOREIGN PATENT DOCUMENTS

| | | | | | |
|---|---|---|---|---|---|
| JP | S62-151377 | U | | 9/1987 | |
| JP | 63305025 | A | * | 12/1988 | B60J 5/10 |
| JP | 1-043298 | Y2 | | 12/1989 | |
| JP | H02-112577 | A | | 4/1990 | |
| JP | H02-121574 | U | | 10/1990 | |
| WO | WO 2011/105328 | A1 | | 9/2011 | |

* cited by examiner

VEHICLE DOOR FIXING APPARATUS

CROSS REFERENCE TO RELATED APPLICATIONS

This application is based on and claims priority under 35 U.S.C. §119 to Japanese Patent Application 2011-184015, filed on Aug. 25, 2011, the entire content of which is incorporated herein by reference.

TECHNICAL FIELD

This disclosure relates to a vehicle door fixing apparatus.

BACKGROUND DISCUSSION

A known vehicle door fixing apparatus is disclosed in JPH1-43298Y (hereinafter referred to as Patent reference 1). As illustrated in FIG. 26, the known vehicle door fixing apparatus disclosed in Patent reference 1 is provided with a fixed wedge 52 including an inclined surface 51 and fixedly attached to a door panel D. The known vehicle door fixing apparatus is also provided with a movable wedge 54 which includes an inclined surface 53 being in contact with the inclined surface 51 in a state where the vehicle door is closed and which is provided at a vehicle body panel B in a reciprocatingly slidable manner. The movable wedge 54 is biased by a spring 55 so as to be pushed against the fixed wedge 52 in a state where the vehicle door is closed, and thus the vehicle door is pushed toward a hinge, and thus a backlash or a rattling of the vehicle door is restricted. The movable wedge 54 is slidably provided at an end surface (an upper surface) of a base plate 56 fixedly attached to the vehicle body panel B, the end surface facing the vehicle door (the fixed wedge 52).

A door lock striker is assumed to be fixed to one of the vehicle body panel B and the door panel D, and a door lock assembly that is engageable with the door lock striker is assumed to be fixed to the other one of the vehicle body panel B and the door panel D. The door lock striker and the door lock assembly are for keeping the vehicle door in, for example, a fully closed state. Because the Patent reference 1 does not include description of the door lock striker or the door lock assembly, the door lock striker and the door lock assembly are assumed to be provided separately from the fixed wedge 52 and the movable wedge 54. Accordingly, man-hours for assembling the known vehicle door fixing apparatus on the vehicle are needed in addition to man-hours for assembling the door lock striker and the like on the vehicle, which may increase assembly man-hours as a whole.

A need thus exists for a vehicle door fixing apparatus which is not susceptible to the drawback mentioned above.

SUMMARY

According to an aspect of this disclosure, a vehicle door fixing apparatus includes a fixed wedge configured to be provided at one of a vehicle body panel and a door panel, and a movable wedge configured to be provided at the other one of the vehicle body panel and the door panel to be movable in an advancing/receding direction of the door panel relative to the vehicle body panel, wherein the movable wedge is configured to be assembled on the other one of the vehicle body panel and the door panel together with a base plate of a door lock striker or with a door lock assembly that is engageable with a shaft of the door lock striker, the movable wedge includes a strength member that is configured to surround a striker-receiving recess provided, for receiving therein the shaft of the door lock striker, at the vehicle body panel or at the door panel any one of which the door lock assembly is assembled on, in a manner that the strength member is opened at a side facing the fixed wedge in the advancing/receding direction, or that is configured to surround the shaft of the door lock striker in the manner that the strength member is opened at the side facing the fixed wedge in the advancing/receding direction, the movable wedge includes a contact member fixedly attached to the strength member and configured to be in pressure contact with the fixed wedge, and the strength member includes a rigidity that is higher than a rigidity of the contact member.

BRIEF DESCRIPTION OF THE DRAWINGS

The foregoing and additional features and characteristics of this disclosure will become more apparent from the following detailed description considered with the reference to the accompanying drawings, wherein:

FIG. 100 is a bottom view of the movable wedge provided at the movable wedge device of the embodiment;

DETAILED DESCRIPTION

Figure 1:
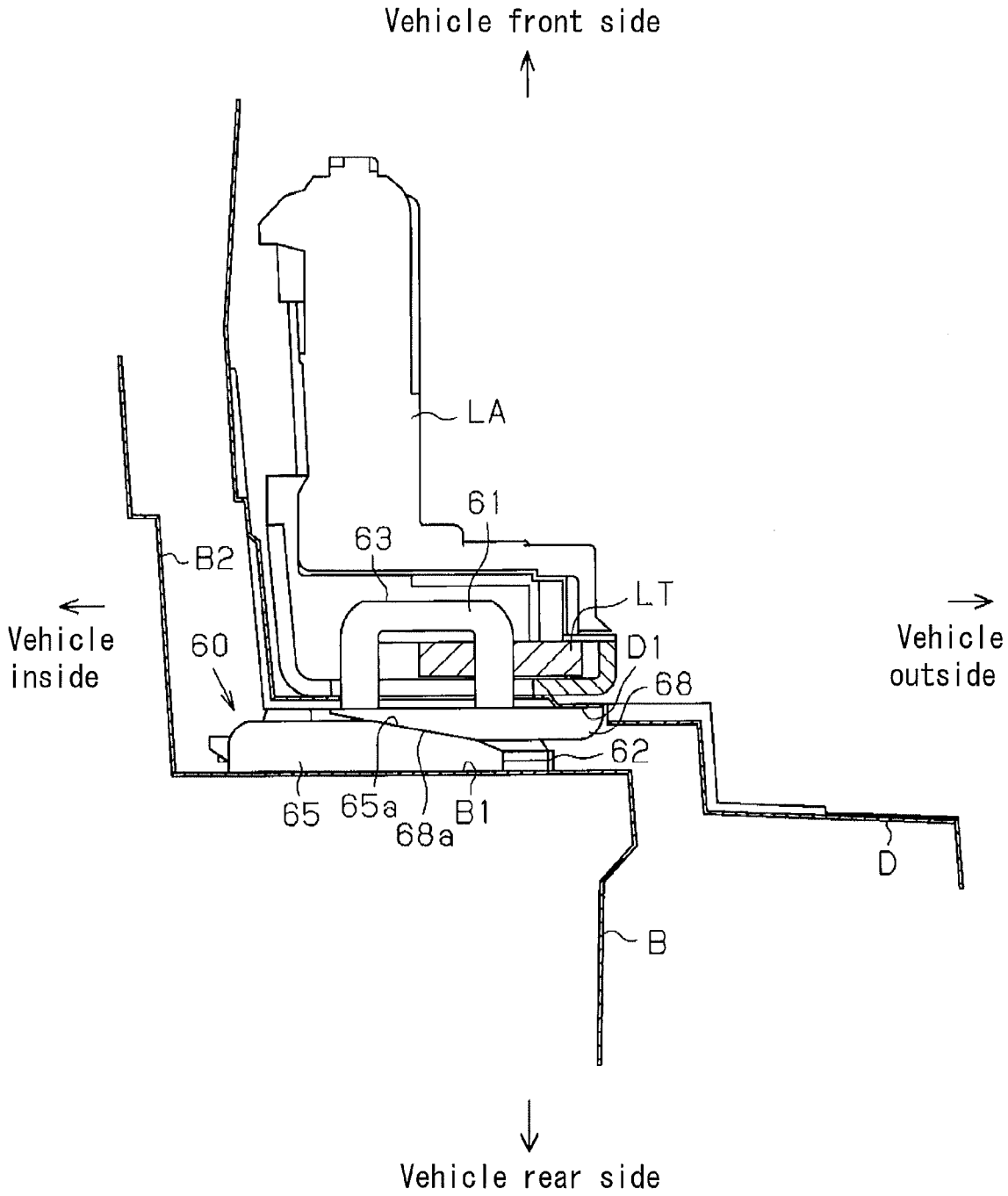
FIG. 1 is a cross-sectional view of a vehicle door fixing apparatus according to an embodiment disclosed here.

A vehicle door fixing apparatus according to an embodiment will be explained with reference to FIGS. 1 to 25. In the embodiment, the vehicle door fixing apparatus is applied to a side door positioned at a front right side of a vehicle having a fully-open air type body structure or a vehicle having a convertible type structure. As illustrated in FIG. 1, a vehicle body panel B (i.e., a side member outer panel) defines an end surface B1 extending in a vehicle width direction and facing a front side of a vehicle (hereinafter referred to also as the end surface B1) at a rear portion of the vehicle relative to a side opening (a door opening) provided at a side portion of the vehicle. The vehicle body panel B also defines a flange B2 extending from an end portion of the end surface B1 toward the front side of the vehicle. The end portion, from which the flange B2 extends, of the end surface B1 is positioned in a vicinity of an inside of the vehicle in the vehicle width direction (a left/right direction when viewed in FIG. 1). A movable wedge device 60, which includes a door lock striker 61 and a movable wedge 65, is provided at the end surface B1.

On the other hand, a door panel D (i.e., a door inner panel) of the vehicle door, which is configured to open and close, in the vehicle width direction, the side opening, defines an end surface D1 extending in the vehicle width direction and positioned forward relative to the end surface B1 to face the end surface B1 (hereinafter referred to also as the end surface D1). A fixed wedge 68 is fixedly attached to the end surface D1 at a portion facing the movable wedge device 60 in a state where the vehicle door is closed. In addition, a door lock assembly LA including a door latch LT that is engageable with and disengageable from the door lock striker 61 is assembled on the door panel D together with the fixed wedge 68, the door lock assembly LA is positioned at an opposite side of the fixed wedge 68 relative to the door panel D.

Figure 2:
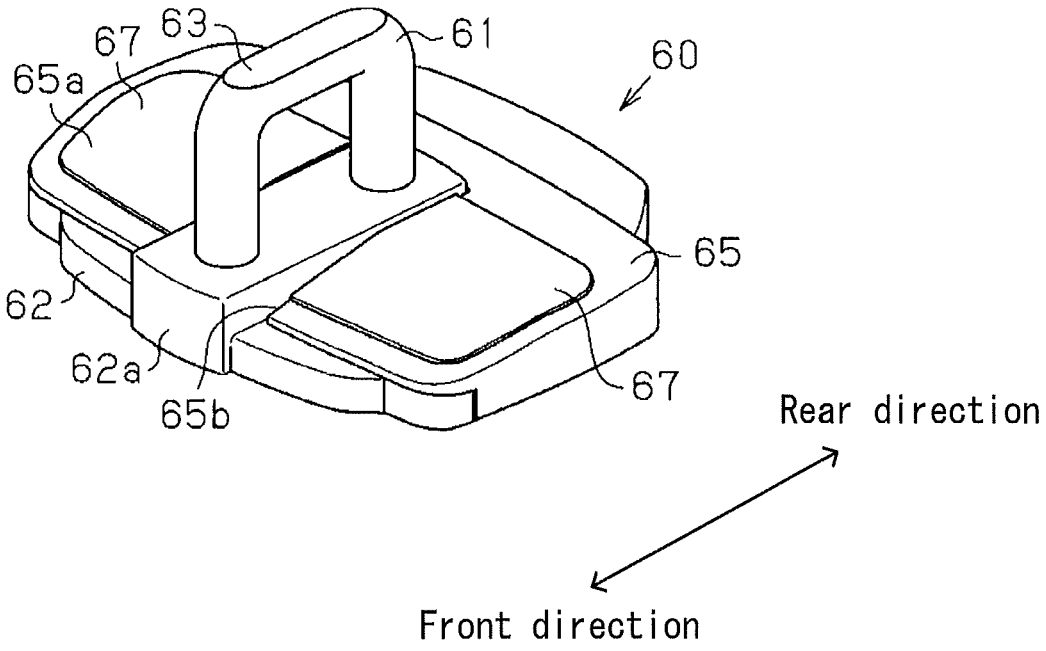
FIG. 2 is a perspective view of a movable wedge device provided at the vehicle door fixing apparatus of the embodiment.
Figure 3:
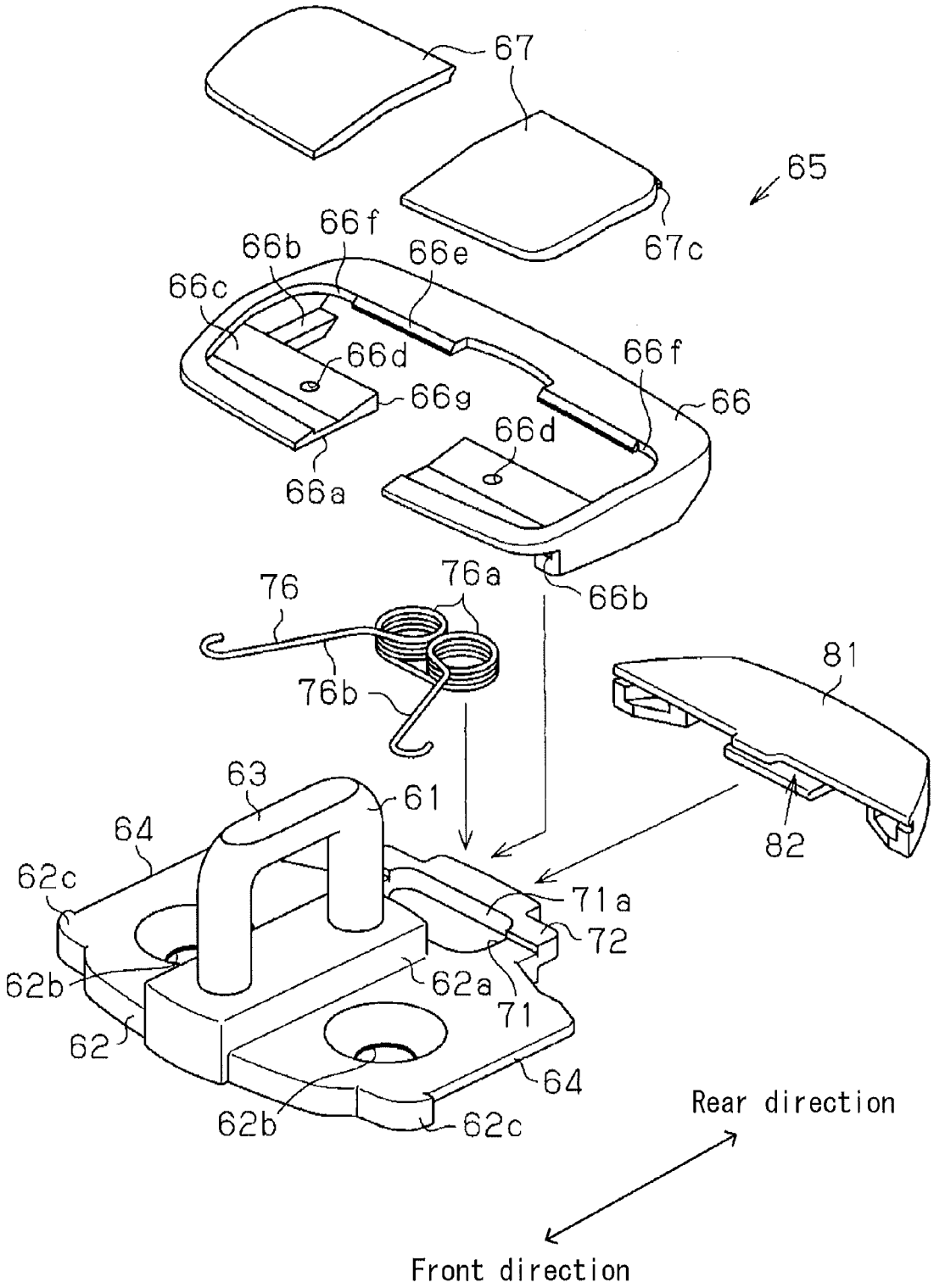
FIG. 3 is an exploded perspective view of the movable wedge device of the embodiment.

Next, the movable wedge device 60 will be further explained. As illustrated in FIGS. 2 and 3, the door lock striker 61 includes a base plate 62 and a shaft 63. The base plate 62 is formed in a substantially flat plate shape spreading on the end surface B1. The shaft 63 is provided at the base plate 62 to protrude in a front direction of the vehicle in a state where the movable wedge device 60 is attached to the vehicle. The shaft 63 is formed to be bent in a substantially U-shaped form so that an end portion thereof, which is positioned farther from the base plate 62, is closed. The movable wedge 65 is configured by a strength member 66 made of, for example, a metal material and a pair of contact members 67, 67 each formed from, for example, a resin panel. The strength member 66 has a higher rigidity than rigidity of the contact members 67, 67.

The movable wedge device 60 is configured by the door lock striker 61, the movable wedge 65, a spring 76 interposed between the door lock striker 61 and the movable wedge 65, and a cover 81 fixedly attached to the base plate 62. For convenience, relative to a direction in which the end portion (that is, a closed portion of the substantially U-shaped form) of the shaft 63 (the door lock striker 61) extends, a direction away from the cover 81 (a diagonally downward left direction in FIGS. 2 and 3) will be hereinafter referred to as a front direction of the movable wedge device 60 (corresponding to a vehicle outside in the vehicle width direction) and a direction toward the cover 81 (corresponding to a diagonally upward right direction in FIGS. 2 and 3) will be hereinafter referred to as a rear direction of the movable wedge device 60 (a vehicle inside in the vehicle width direction).

As illustrated in FIGS. 7A to 7D, a guide protruding portion 62*a* is formed at the base plate 62 of the door lock striker 61 to protrude in a protruding direction of the shaft 63 so as to match end portions, which are positioned in a vicinity of the base plate 62, of the shaft 63. The guide protruding portion 62*a* has a substantially rectangular column shape and extends substantially between a front end portion and a rear end portion of the shaft 63. The guide protruding portion 62*a* is formed to extend in a front/rear direction of the door lock striker 61 (the movable wedge device 60) so as to bridge the front and the rear end portions, both of which are positioned in the vicinity of the base plate 62, of the shaft 63. The front end portion and the rear end portion of the shaft 63 are fixed to the base plate 62 at the guide protruding portion 62*a* by caulking. A bolt hole 62*b* to which a bolt for fixing the base plate 62 to the vehicle body panel B is inserted is formed at the base plate 62 at each side relative to the guide protruding portion 62*a* (the shaft 63) in a lengthwise direction of the movable wedge device 60. A guide rail 64 having a substantially rectangular cross-section is formed at each side portion, in the lengthwise direction, of the base plate 62 to linearly extend in the front/rear direction of the door lock striker 61 (the movable wedge device 60). Further, a locking tab 62*c* formed in a tab shape is provided at a front end portion of each guide rail 64 in a manner that the pair of locking tabs 62*c*, 62*c* protrudes in a direction away from each other.

The base plate 62 is provided with a supporting portion 71*a* positioned behind the shaft 63 and supporting part of the spring 76. A spring accommodating portion 71 formed in a substantially rectangular shape and providing an accommodation space for the spring 76 is formed at a rear portion of the base plate 62. The spring accommodating portion 71 is constituted by a hole formed at the rear portion of the base plate 62 and a rear wall portion of the spring accommodating portion 71 serves as the supporting portion 71*a*. The base plate 62 further includes a step portion 72 formed at a rear end of the base plate 62 to rise in the protruding direction of the shaft 63 so as to be higher than other portions surrounding the step portion 72.

As illustrated in FIG. 3, the spring 76 includes plural coil portions 76*a*, for example, a pair of coil portions 76*a*, 76*a*, and an arm portion 76*b* protruding from each coil portion 76*a*. Each coil portion 76*a* is wound in a coiled configuration and is arranged at each side relative to the shaft 63 in the lengthwise direction. The spring 76 is formed in a bilaterally symmetrical shape relative to the shaft 63. The coil portions 76*a*, 76*a* are wound in reverse directions to each other, and are connected to each other at a side opposite to the protruding direction of the shaft 63. The arm portions 76*b*, 76*b*, which are connected to the coil portions 76*a*, 76*a*, protrude in diagonally forward directions so that end portions thereof become gradually away from each other.

Figure 4:
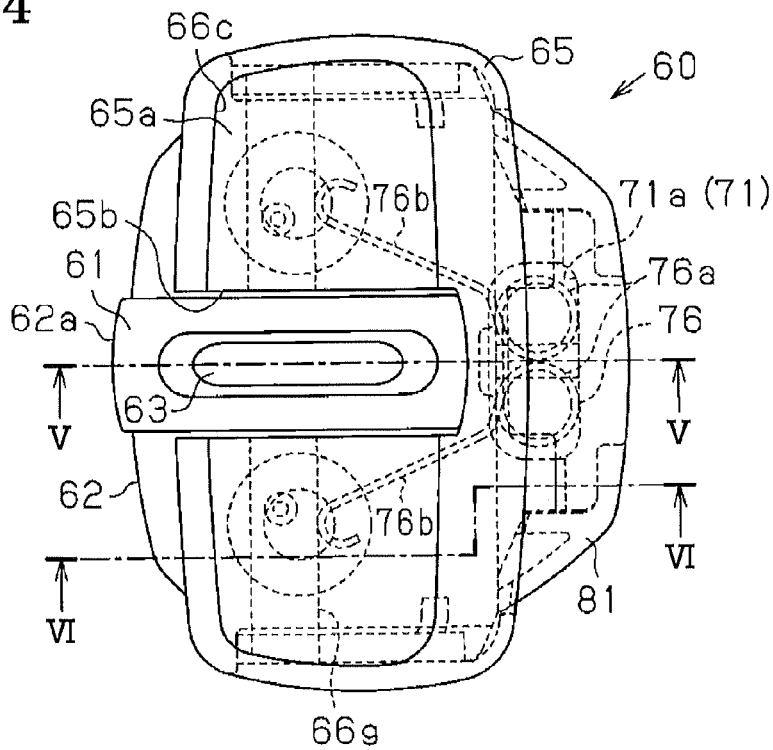
FIG. 4 is a plan view of the movable wedge device of the embodiment.

As illustrated in FIG. 4, the coil portions 76*a*, 76*a* are accommodated in the spring accommodating portion 71, and the supporting portion 71*a* supports each coil portion 76*a*, at a portion positioned opposite to a direction in which the pair of arm portions 76*b*, 76*b* protrudes. In other words, the supporting portion 71*a* serves as a supporting surface being into contact with an outer circumferential surface of each coil portion 76*a*. The arm portions 76*b*, 76*b* are laid on the base plate 62 to be positioned at both sides relative to the shaft 63 in the lengthwise direction of the movable wedge device 60.

Figure 5:
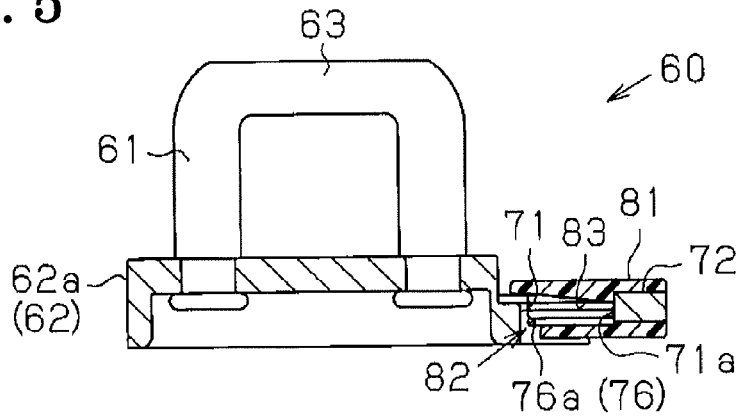
FIG. 5 is a cross-sectional view of the movable wedge device taken along line V-V in FIG. 4.
Figure 8A:
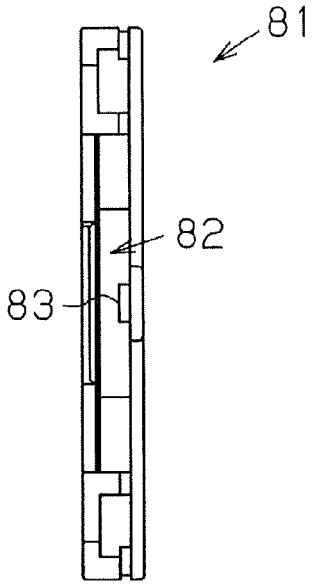
FIG. 8A is a front view of a cover assembled on the door lock striker of the embodiment.
Figure 8B:
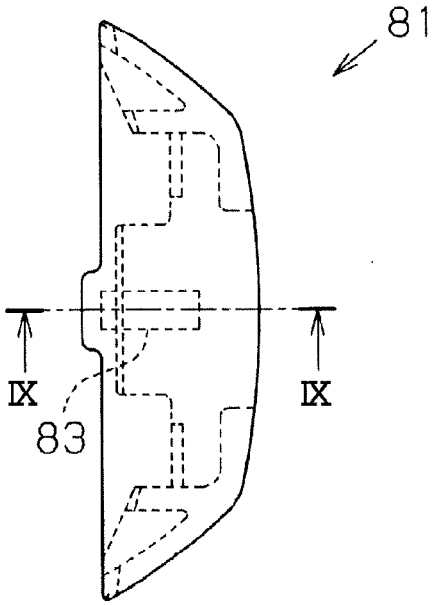
FIG. 8B is a plan view of the cover assembled on the door lock striker of the embodiment.
Figure 9:
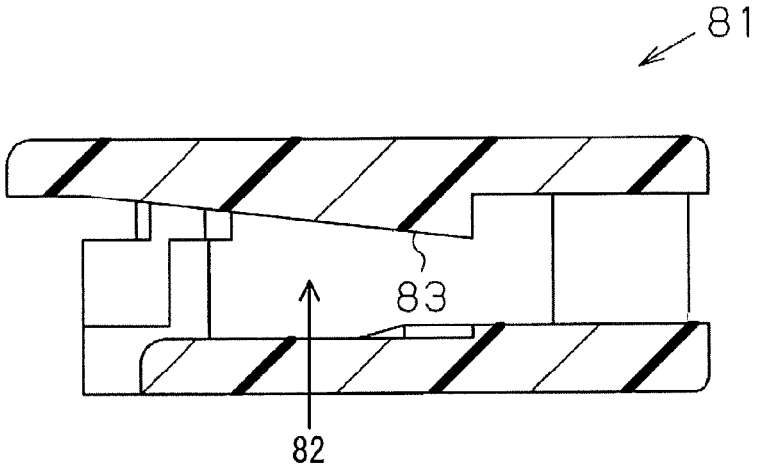
FIG. 9 is a cross-sectional view of the cover taken along line IX-IX in FIG. 8B.
Figure 10C:
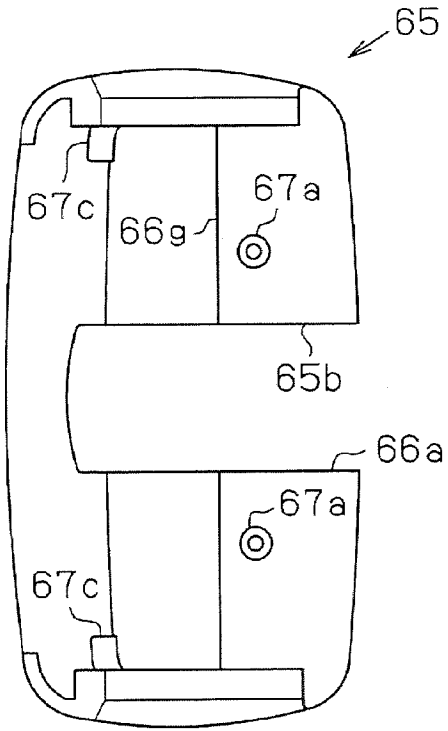
FIG. 10A is a top view of a movable wedge provided at the movable wedge device of the embodiment.
FIG. 10B is a front view of the movable wedge provided at the movable wedge device of the embodiment.
FIG. 10D is a side view of the movable wedge provided at the movable wedge device of the embodiment.
Figure 10B:
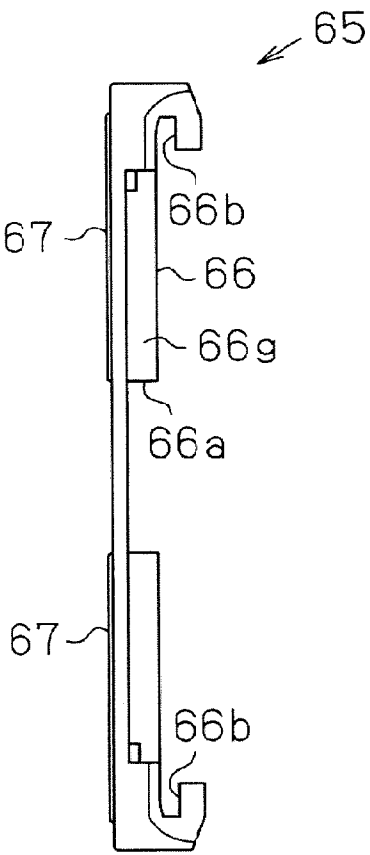
Figure 10A:
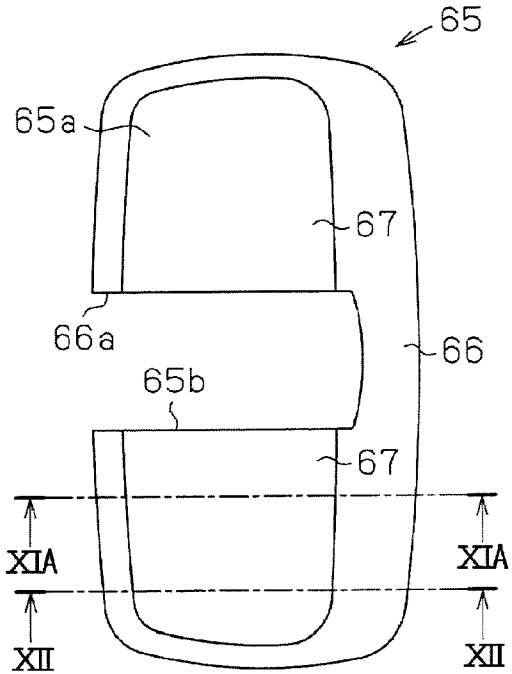
Figure 10D:
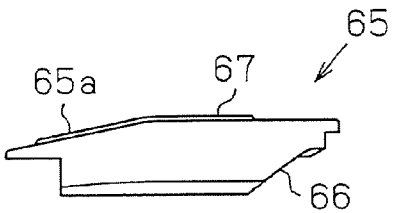

As illustrated in FIGS. 5, 8A and 8B, the cover 81 includes an accommodation space 82 for accommodating, in cooperation with the base plate 62 (the spring accommodating portion 71), inside thereof the spring 76. As illustrated in FIG. 9, the accommodation space 82 is formed so as to penetrate from a front end to a rear end of the cover 81.

Figure 6:
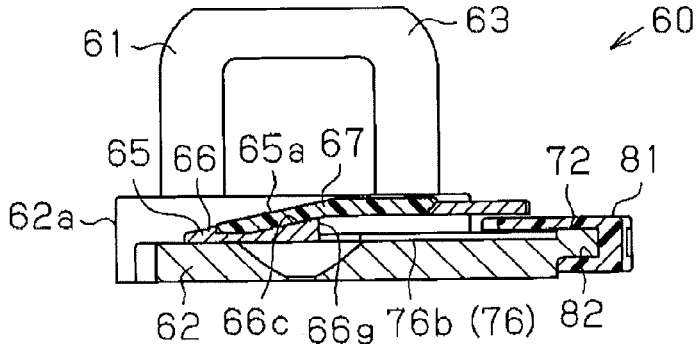
FIG. 6 is a cross-sectional view of the movable wedge device taken along line VI-VI in FIG. 4.
Figure 7A:
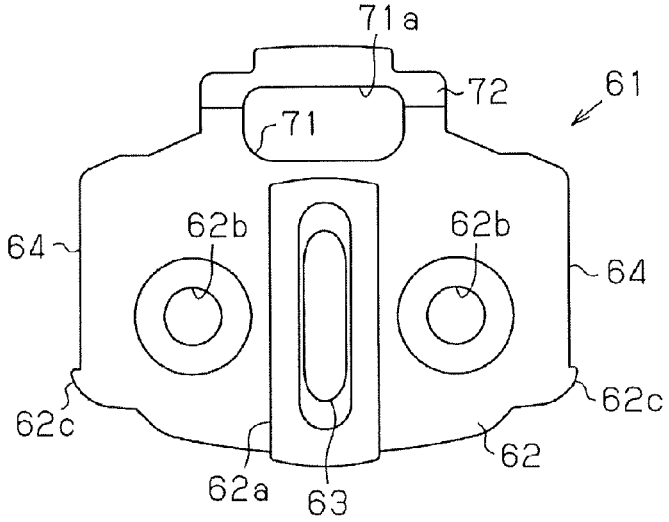
FIG. 7A is a top view of a door lock striker provided at the movable wedge device of the embodiment.
Figure 7B:
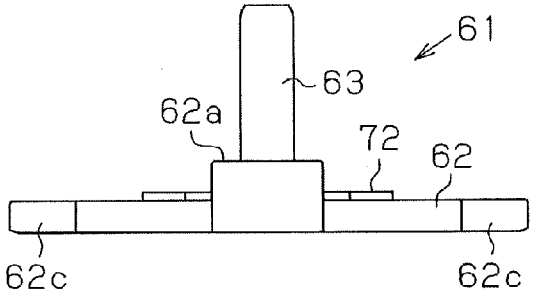
FIG. 7B is a front view of the door lock striker provided at the movable wedge device of the embodiment.
Figure 7D:
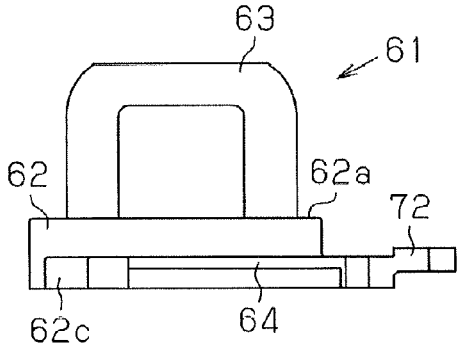
FIG. 7D is a side view of the door lock striker provided at the movable wedge device of the embodiment.
Figure 7C:
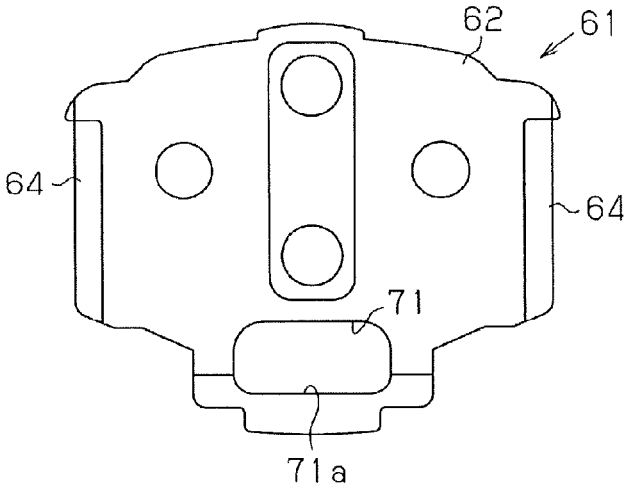
FIG. 7C is bottom view of the door lock striker provided at the movable wedge device of the embodiment.

A tab 83 is formed at a front portion of the cover 81 so as to be interposed between the coil portions 76*a*, 76*a*. A rear end portion of the base plate 62 fits in the accommodation space 82 as illustrated in FIG. 6, and the tab 83 engages with the step portion 72 of the base plate 62 as illustrated in FIG. 5, and thus the cover 81 is fixed to the base plate 62. End portions, which face the protruding direction of the shaft 63 and the opposite direction thereto respectively, of each coil portion 76*a* are supported by inner walls, which face each other, of the accommodation space 82. A rear end of each coil portion 76*a* is supported by a side wall of the spring accommodating portion 71.

The movable wedge 65 is provided at the base plate 62 in a manner that the movable wedge 65 covers an end surface of the base plate 62, the end surface which faces the protruding direction of the shaft 63. As illustrated in FIG. 3, the strength member 66 of the movable wedge 65 is formed in a substantially rectangular frame-like shape and includes a guide groove 66*a* serving as an opening portion and formed in a substantially central portion of a front edge portion of the strength member 66 and extending in the front/rear direction of the movable wedge 65. A guide groove 66*b* is formed at each edge portion, in the lengthwise direction, of the strength member 66 to extend in the front/rear direction of the movable wedge device 60. Communication is provided between a front end and a rear end of each guide groove 66*b*. The guide grooves 66*b*, 66*b* include substantially U-shaped cross sections and openings of the U-shaped cross sections face each other. The guide groove 66*a* slidably engages with the guide protruding portion 62*a* of the base plate 62 and the guide grooves 66*b*, 66*b* engage with the guide rails 64, 64 provided at the base plate 62, respectively, and thus the strength member 66 is movable relative to the base plate 62 in the front/rear direction of the movable wedge device 60 within a certain range. In other words, the strength member 66 (the movable wedge 65) is slidable relative to the base plate 62 in the front/rear direction of the movable wedge device 60 via a pair of rail mechanisms, which is constituted by the guide rails 64, 64 and the guide grooves 66*b*, 66*b*, or other mechanism.

Figure 11A:
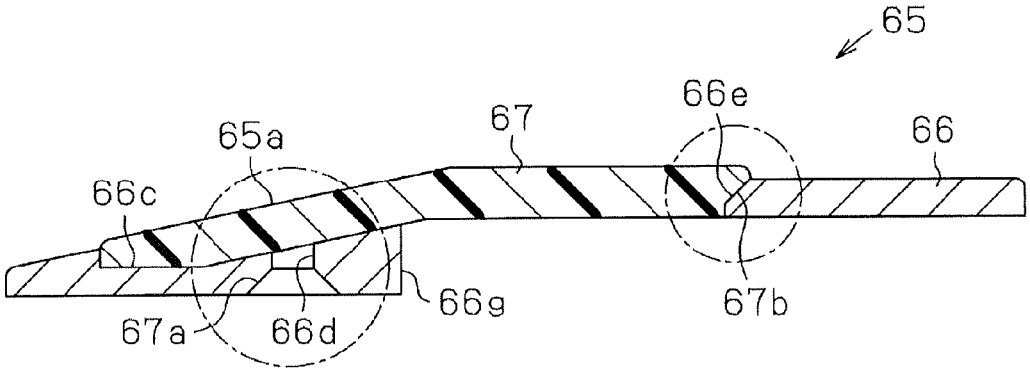
FIG. 11A is a cross-sectional view of the movable wedge taken along line XIA-XIA in FIG. 10A.
Figure 11B:
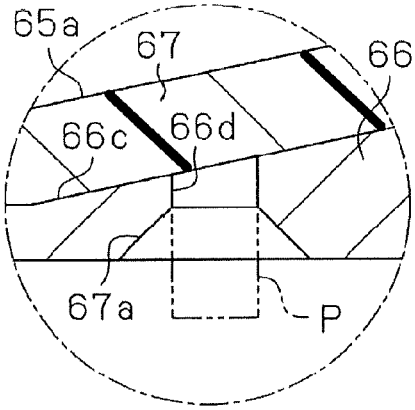
FIG. 11B is an enlarged view of a portion (that is, the portion indicated by the alternate long and short dash line on the left in FIG. 11A of FIG. 11A.
Figure 11C:
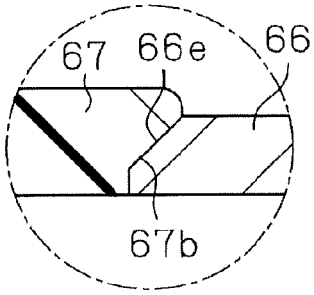
FIG. 11C is an enlarged view of a portion (that is, the portion indicated by the alternate long and short dash line on the right in FIG. 11A of FIG. 11A.
Figure 12:
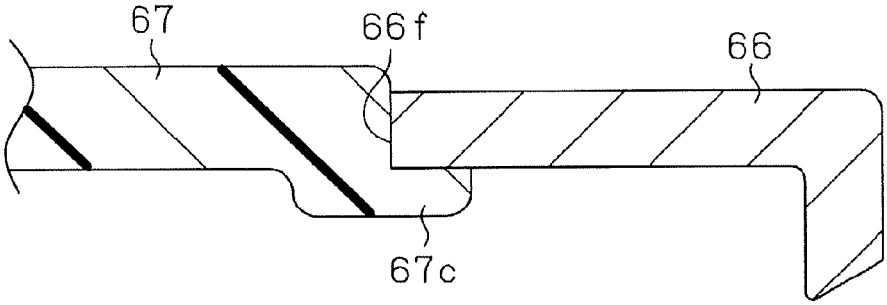
FIG. 12 is a cross-sectional view of the movable wedge taken along line XII-XII in FIG. 10A.

An attachment recessed portion 66*c* is formed at a rear portion of the front edge portion of the strength member 66 to be recessed in a direction of the base plate 62 and to extend over a substantially entire length of the strength member 66 in the lengthwise direction. The strength member 66 includes a pair of attachment holes 66*d*, 66*d* formed in a manner that each attachment hole 66*d* is positioned at each side relative to the guide groove 66*a* and penetrates the strength member 66 in a thickness direction thereof (in the protruding direction of the shaft 63). As illustrated in FIGS. 11A and 11C, a chamfered portion 66*e* having a sloped configuration is formed at a front end portion of a rear edge portion of the strength member 66. The chamfered portion 66*e* is positioned at an intermediate portion of the strength member 66 in an extending direction thereof. Thus, due to the chamfered portion 66*e*, the rear edge portion of the strength member 66 is formed in a manner that the rear edge portion, which is positioned in a vicinity of the base plate 62, of the strength member 66 becomes thinner toward the front direction of the movable wedge device 60. As illustrated in FIG. 12, at each end portion, in the extending direction of the strength member 66, of the rear edge portion of the strength member 66, a locking portion 66*f* standing at a substantially right angle is formed instead of the chamfered portion 66*e*.

As illustrated in FIG. 3, the contact members 67, 67 of the movable wedge 65 are fixed to the strength member 66 so as to be laid on the attachment recessed portion 66*c* at each side relative to the guide groove 66*a*. As illustrated in FIGS. 11A and 11B, an attachment protruding portion 67*a* is formed at a front end portion of each contact member 67. An end portion of each attachment protruding portion 67*a*, which is formed in a flanged shape, is inserted in and penetrates through the corresponding attachment hole 66*d*. Each attachment protruding portion 67*a* serves as a disengagement-prevention protruding portion by engaging with an edge portion of the attachment hole 66*d*. As illustrated in FIG. 11B, the attachment protruding portion 67*a* is formed by welding an end portion of a pin P, which has a substantially cylindrical shape and which is for penetrating through the attachment hole 66*d*, so that an end portion of the pin P is formed in the flanged shape.

As illustrated in FIG. 11C, a chamfered portion 67*b* having a sloped configuration and serving as a disengagement-prevention portion is formed at a rear edge portion of each contact member 67, that is, an end portion of each contact member 67. The chamfered portion 67*b* is positioned at an intermediate portion of each contact member 67 in the extending direction thereof so that the chamfered portion 67*b* of the contact member 67 faces the corresponding chamfered portion 66*e* of the strength member 66. Thus, due to the chamfered portion 67*b*, the rear edge portion of each contact member 67 is formed in a manner that an end portion, which is positioned away from the base plate 62, of the rear edge portion of the chamfered portion 67*b* becomes thinner toward the rear direction of the movable wedge device 60. As illustrated in FIG. 12, a locking tab 67*c* serving as the disengagement-prevention portion is formed at the rear edge portion of each contact member 67, at a portion facing the corresponding locking portion 66*f*, that is, the end portion of each contact member 67. Each locking tab 67*c* is formed protruding in the rear direction of the movable wedge device 60 so as to be in contact with a surface, which faces the base plate 62, of the locking portion 66*f* so that each attachment protruding portion 67*a* does not come off or disengage from the attachment hole 66*d*. Accordingly, the chamfered portion 67*b* and the locking tab 67*c* of each contact member 67 are in contact with the chamfered portion 66*e* and the surface, which faces the base plate 62, of the locking portion 66*f* of the strength member 66, respectively. Thus, the rear edge portion of each contact member 67 retains the front end portion of the rear edge portion of the strength member 66 in the thickness direction thereof in a sandwiching manner where the chamfered portion 67*b* and the locking tab 67*c* sandwich therebetween the front end portion of the rear edge portion of the strength member 66. Consequently, each contact member 67 is restricted from coming off or disengaging from the strength member 66 in the thickness direction thereof.

In order to assemble each contact member 67 on the strength member 66, the contact member 67 is moved rearward relative to the strength member 66 so that the front end portion of the rear edge portion of the strength member 66 is brought to be retained in the sandwiched manner between the chamfered portion 67*b* and the locking tab 67*c* in the thickness direction thereof. In this state, the contact member 67 is pivoted about a pivot point, that is, for example, the chamfered portion 67*b*, toward the strength member 66 in the thickness direction of the strength member 66 while the pin P is inserted in the corresponding attachment hole 66*d* so that the contact member 67 is laid on the attachment recessed portion 66*c*. The end portion of the pin P, which penetrates through the attachment hole 66*d*, is welded to have the flanged shape, and thus the attachment protruding portion 67*a* is formed. Thus, each contact member 67 is fixedly attached to the strength member 66 and restricted from disengaging from the strength member 66.

As illustrated in FIGS. 10A to 10D and 11A, the movable wedge 65 includes an inclined surface 65*a* which is formed at the front portion of each contact member 67 fixed to the strength member 66 and which is inclined so as to be closer to the strength member 66 in the thickness direction thereof toward the front direction of the movable wedge 65. The movable wedge 65 also includes a slit 65*b* cut off from the front direction of the movable wedge 65. The slit 65*b* is positioned between the pair of contact members 67, 67 each of which is fixed to the attachment recessed portion 66*c* at each side relative to the guide groove 66*a*. In other words, the entire movable wedge 65 slidably engages with the guide protruding portion 62*a* (the door lock striker 61) of the base plate 62 at the slit 65*b*.

In order to assemble the movable wedge device 60, the guide groove 66*a* of the strength member 66 (the movable wedge 65) is slid relative to the guide protruding portion 62*a* of the base plate 62 from a rear direction toward a front direction of the base plate 62 as illustrated in FIG. 3, while sliding the guide grooves 66*b*, 66*b* into the guide rails 64, 64 formed at side portions of the base plate 62. While retaining the above-described state, the arm portions 76*b*, 76*b*, each protruding diagonally in the front direction of the movable wedge device 60, are pressed against a rear end surface 66*g* of the front edge portion of the strength member 66 as illustrated in FIGS. 4 to 6, and the coil portions 76*a*, 76*a* are accommodated in the spring accommodating portion 71. At this time, the arm portions 76*b*, 76*b* of the spring 76 are pushed by the rear end surface 66*g* and thus an angle between arm portions 76*b*, 76*b* increases, that is, a distance between the arm portions 76*b*, 76*b* increases. Thus, torsional forces are generated at the coil portions 76*a*, 76*a*, thereby generating a biasing force in a direction in which the angle between the arm portions 76*b*, 76*b* decreases. Accordingly, the strength member 66 (the movable wedge 65) is biased in the front direction thereof by the spring 76. Accordingly, the strength member 66 is always biased relative to the base plate 62 in the front direction of the movable wedge device 60 so that a rear end edge portion of the strength member 66 is in contact with a rear end surface of the guide protruding portion 62*a* of the base plate 62 or so that a front end surface of each guide groove 66*b* is in contact with the corresponding locking tab 62*c* of the base plate 62.

Next, the rear end portion of the base plate 62 is fitted into the accommodation space 82 of the cover 81 and the tab 83 is engaged with the step portion 72 of the base plate 62, so that the cover 81 is fixed to the base plate 62. At this time, end portions, which face the protruding direction of the shaft 63 and the opposite direction thereto, of each coil portion 76*a* are supported by the inner walls, which face each other, of the accommodation space 82. The rear end of each coil portion 76*a* is supported by the side wall of the spring accommodating portion 71.

Figure 13:
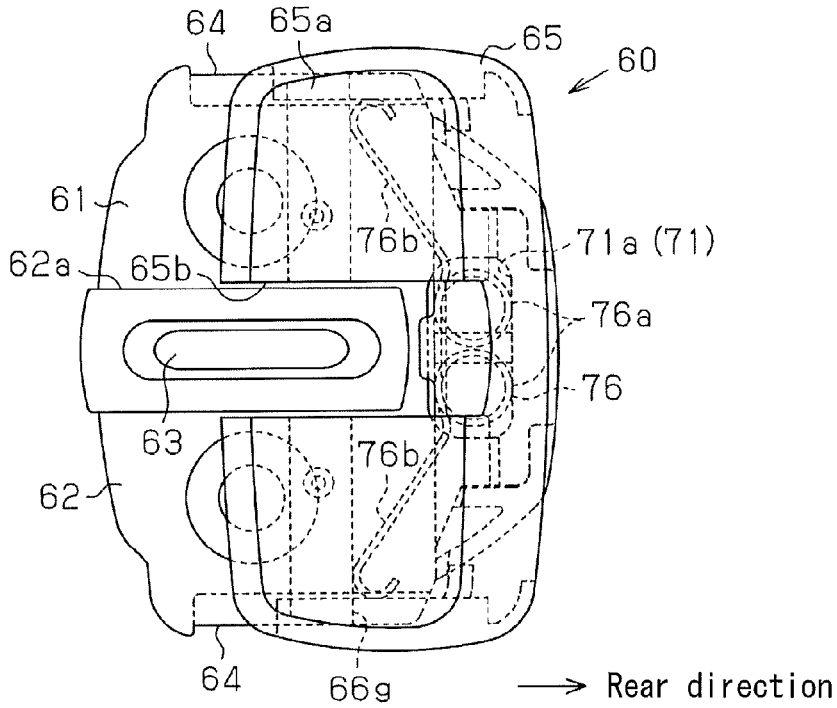
FIG. 13 is a plan view illustrating a movement of the movable wedge device of the embodiment.
Figure 14:
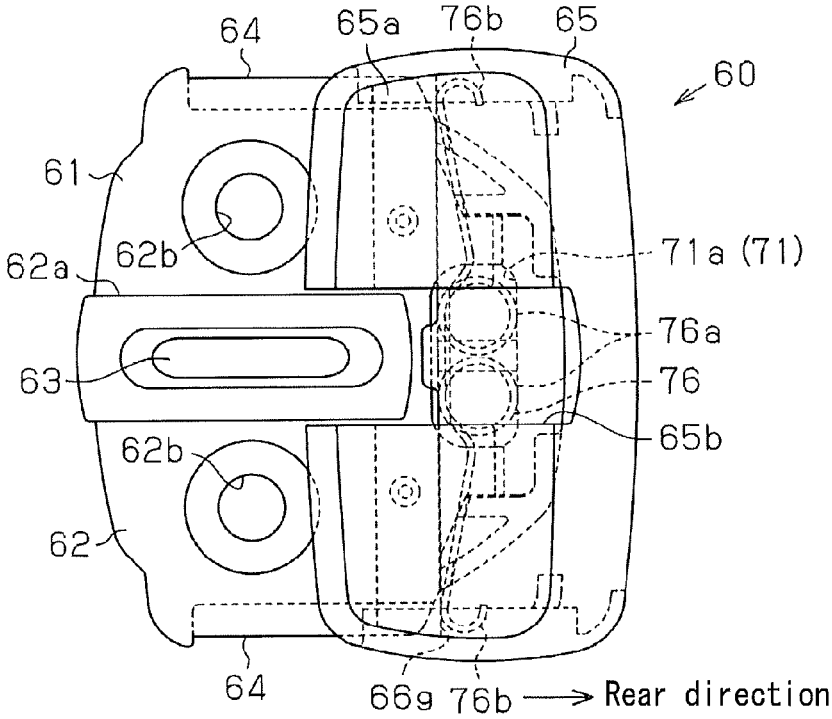
FIG. 14 is a plan view of the movable wedge device of the embodiment before being assembled, for example, on the vehicle.

As described above, the assembly of the movable wedge device 60 is completed. Thus, as illustrated in FIG. 13, the movable wedge 65 that is always biased by the spring 76 in the front direction of the movable wedge device 60 relative to the base plate 62 is movable in the rear direction against the biasing force of the spring 76. At this time, the arm portions 76*b*, 76*b* are pushed by the rear end surface 66*g* of the strength member 66 and the angle between the arm portions 76*b*, 76*b* increases, and thus the biasing force in the direction in which the angle between the arm portions 76*b*, 76*b* decreases, that is, the biasing force biasing the strength member 66 (the movable wedge 65) in the front direction, is generated. As illustrated in FIG. 14, as the movable wedge 65 moves further in the rear direction against the biasing force of the spring 76, the bolt holes 62*b*, 62*b* are configured to be exposed in a direction in which the bolts are attached to or inserted in the bolt holes 62*b*, 62*b*, respectively.

Figure 15:
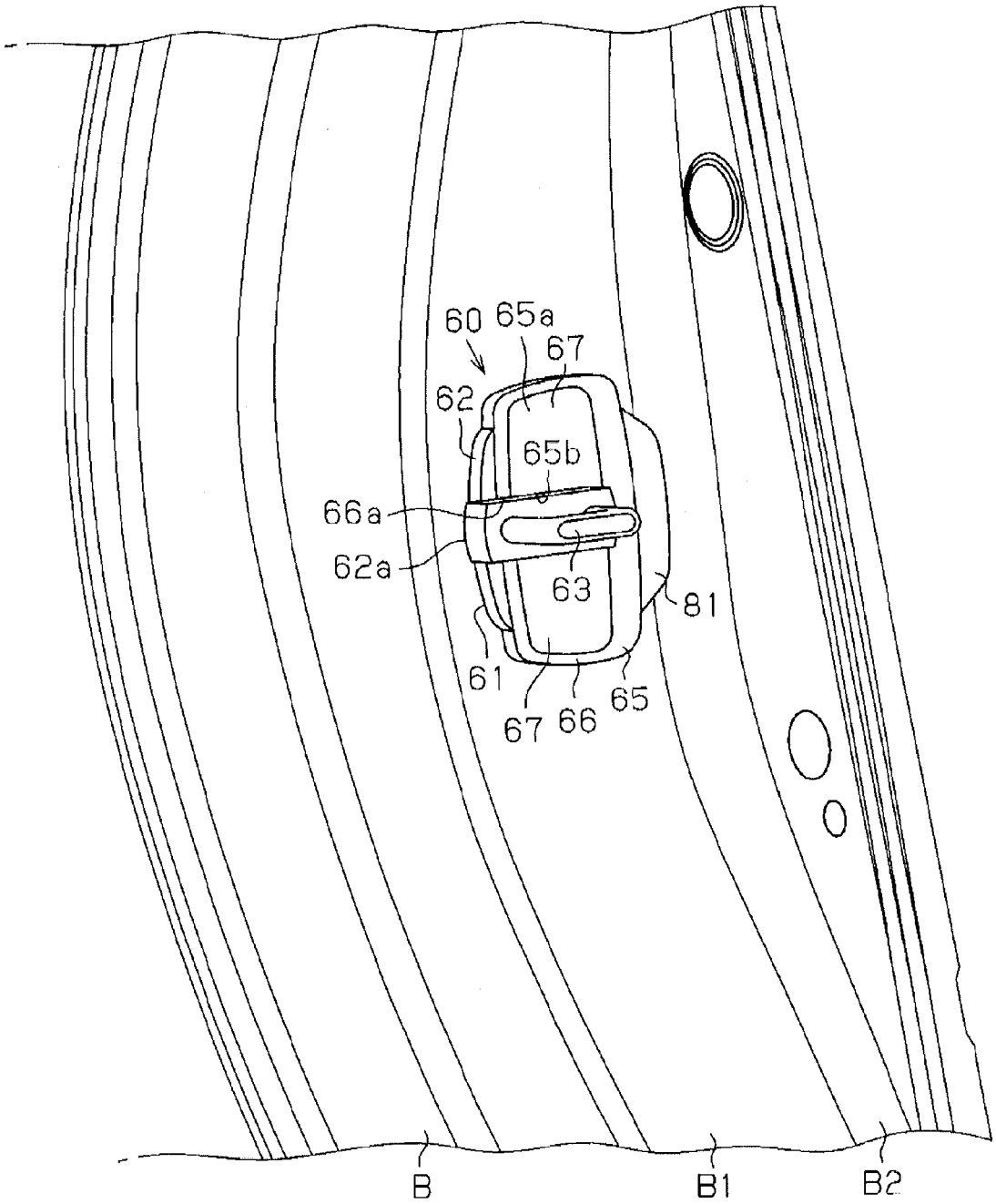
FIG. 15 is a perspective view illustrating a manner in which the movable wedge device of the embodiment is provided at the vehicle.

As illustrated in FIGS. 1 and 15, the movable wedge device 60 having the above-explained structure is fixedly attached to the end surface B1. In a state where the movable wedge device 60 is attached to the end surface B1, a direction in which the end portion of the shaft 63 (the door lock striker 61) extends (that is, the front/rear direction of the movable wedge device 60 and a moving direction of the movable wedge 65) coincides with the vehicle width direction. In other words, the moving direction of the movable wedge 65 coincides with an advancing/receding direction of the door panel D relative to the vehicle body panel B, that is, the direction in which the door panel D comes closer to or away from the vehicle body panel B when the vehicle door is operated for opening and closing. Consequently, the movable wedge 65 (the strength member 66) surrounds the shaft 63 of the door lock striker 61 in a manner that the movable wedge 65 is opened, due to the guide groove 66*a*, at a side facing the fixed wedge 68 in the advancing/receding direction of the door panel D relative to the vehicle body panel B. The inclined surface 65*a* is inclined so as to gradually come closer to the end surface B1 toward the vehicle outside in the vehicle width direction.

In order to attach the movable wedge device 60 to the end surface B1, the movable wedge 65 is moved in the rear direction thereof (that is, in the vehicle inside direction in the vehicle width direction) as explained above against the biasing force of the spring 76 so that the bolt holes 62*b*, 62*b* are exposed. In a state where the bolt holes 62*b*, 62*b* are exposed, the bolts for fixing the base plate 62 to the vehicle body panel B are inserted in the bolt holes 62*b*, 62*b* and are tightened to the vehicle body panel B. After the movable wedge device 60 is attached to the end surface B1 and the movable wedge 65 is released, the movable wedge 65 is biased by the spring 76 in the front direction of the movable wedge device 60 so that the rear end edge portion of the strength member 66 comes in contact with the rear end surface of the guide protruding portion 62*a* of the base plate 62 or so that the front end surface of each guide groove 66*b* comes in contact with the corresponding locking tab 62*c* of the base plate 62. Accordingly, the bolt holes 62*b*, 62*b* (and the bolts inserted therein) come to be covered with the movable wedge 65 so as not to be exposed to the outside. Thus, the movable wedge device 60 is configured so that the bolt holes 62*b*, 62*b* and, for example, the bolts inserted therein are covered with the movable wedge 65 so as not to be exposed to the outside in a normal state, that is, in the state where the movable wedge 65 is not slid in the rear direction thereof against the biasing force of the spring 76.

Figure 16:
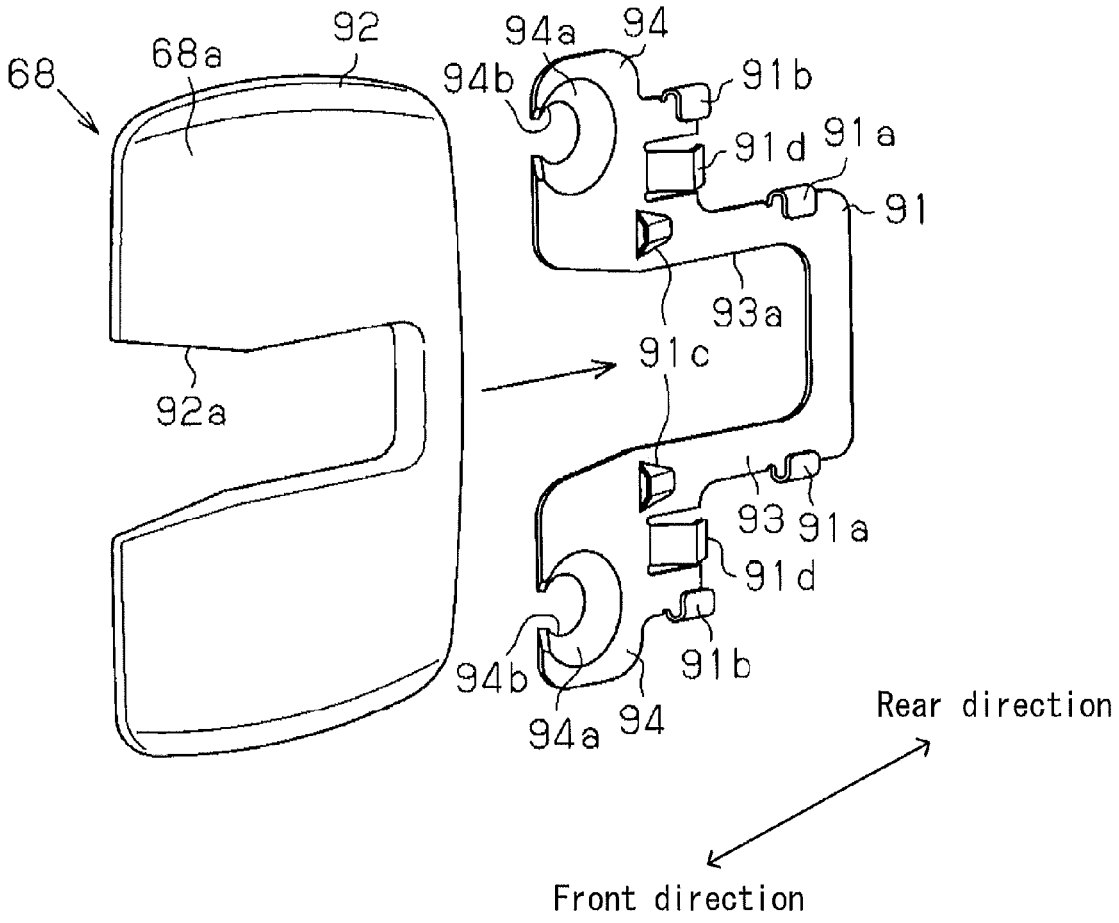
FIG. 16 is an exploded perspective view of the fixed wedge provided at the vehicle door fixing apparatus of the embodiment.

Next, the fixed wedge 68 will be described in more detail. As illustrated in FIG. 16, the fixed wedge 68 includes an attachment member 91 made of, for example, a metal plate and a wedge member 92 made of, for example, a resin material. The attachment member 91 includes a body portion 93 and a pair of extending portions 94, 94, which are formed as one piece. The body portion 93 includes a slit portion 93*a* formed into a substantially rectangular shape, and thus the body portion 93 is formed in a substantially U-shape. The pair of extending portions 94, 94 extends outwardly, that is, the extending portions 94, 94 extend in opposite directions from each other, from the body portion 93, in a vicinity of an opening of the slit portion 93*a* so as to be positioned both sides relative to the opening portion of the slit portion 93*a*. The attachment member 91 is symmetrically constructed relative to the slit portion 93*a*. Hereunder, for convenience, a direction in which the substantially U-shape of the body portion 93 (the attachment member 91) opens (a diagonally downward left direction in FIG. 16) corresponds also to a front direction of the fixed wedge 68 and the opposite direction to the front direction of the fixed wedge 68 (a diagonally upward right direction in FIG. 16) corresponds also to a rear direction of the fixed wedge 68.

The attachment member 91 includes a pair of guide rails 91*a*, 91*a* for the fixed wedge and a pair of guide rails 91*b*, 91*b* for the fixed wedge. The guide rails 91*a*, 91*a* for the fixed wedge are formed at outer edges of a rear portion of the body portion 93, respectively so as to rise and bend in a direction in which the guide rails 91*a*, 91*a* for the fixed wedge face each other. Each guide rail 91*b* for the fixed wedge is formed at an outer edge of a rear portion of each extending portion 94 so as to rise and bend in a manner that the guide rails 91*b*, 91*b* for the fixed wedge face each other. Each of the guide rails 91*a*, 91*a*, and 91*b*, 91*b* is formed in a substantially shape of a letter L. The pair of guide rails 91*b*, 91*b* for the fixed wedge may be bent in a direction away from each other. The attachment member 91 includes a pair of first locking portions 91*c*, 91*c* formed forward relative to the pair of guide rails 91*a*, 91*a* for the fixed wedge, respectively and each first locking portion 91*c* rises to have a substantially semi-dome shape. Each first locking portion 91*c* protrudes in a direction in which, for example, the guide rails 91*a*, 91*a* for the fixed wedge rise. The pair of first locking portions 91*c*, 91*c* is configured so that a protruding length of each first locking portion 91*c* becomes progressively longer from a rear portion to a front portion thereof. An engagement protruding portion 91*d* is formed at the attachment member 91, between each guide rail 91*b* for the fixed wedge and the corresponding first locking portion 91*c*, by cutting and raising a rear edge of the corresponding extending portion 94 so that the cut portion is folded at a fold line, that is, a front end of the cut portion, diagonally in the direction in which the first locking portion 91*c* rises. A rear end portion of each engagement protruding portion 91*d* is bent toward the attachment member 91, and thus each engagement protruding portion 91*d* is formed in a protruding shape.

A recessed portion 94*a* having a substantially conical shape is formed at each extending portion 94 to serve as a bearing surface for a bolt for fixing the attachment member 91 (the fixed wedge 68) to the door panel D. At a substantially center of each recessed portion 94*a*, a bolt hole 94*b* into which the bolt is inserted is formed. Each bolt hole 94*b* has a substantially major arc shape that opens in the front direction of the fixed wedge 68 in order for reducing a size of the attachment member 91 (the pair of extending portions 94, 94) in the front/rear direction of the fixed wedge 68. Each bolt hole 94*b* does not need to open in the front direction in case there is no need to reduce the size of the attachment member 91 (the pair of extending portions 94, 94) in the front/rear direction.

Figure 17:
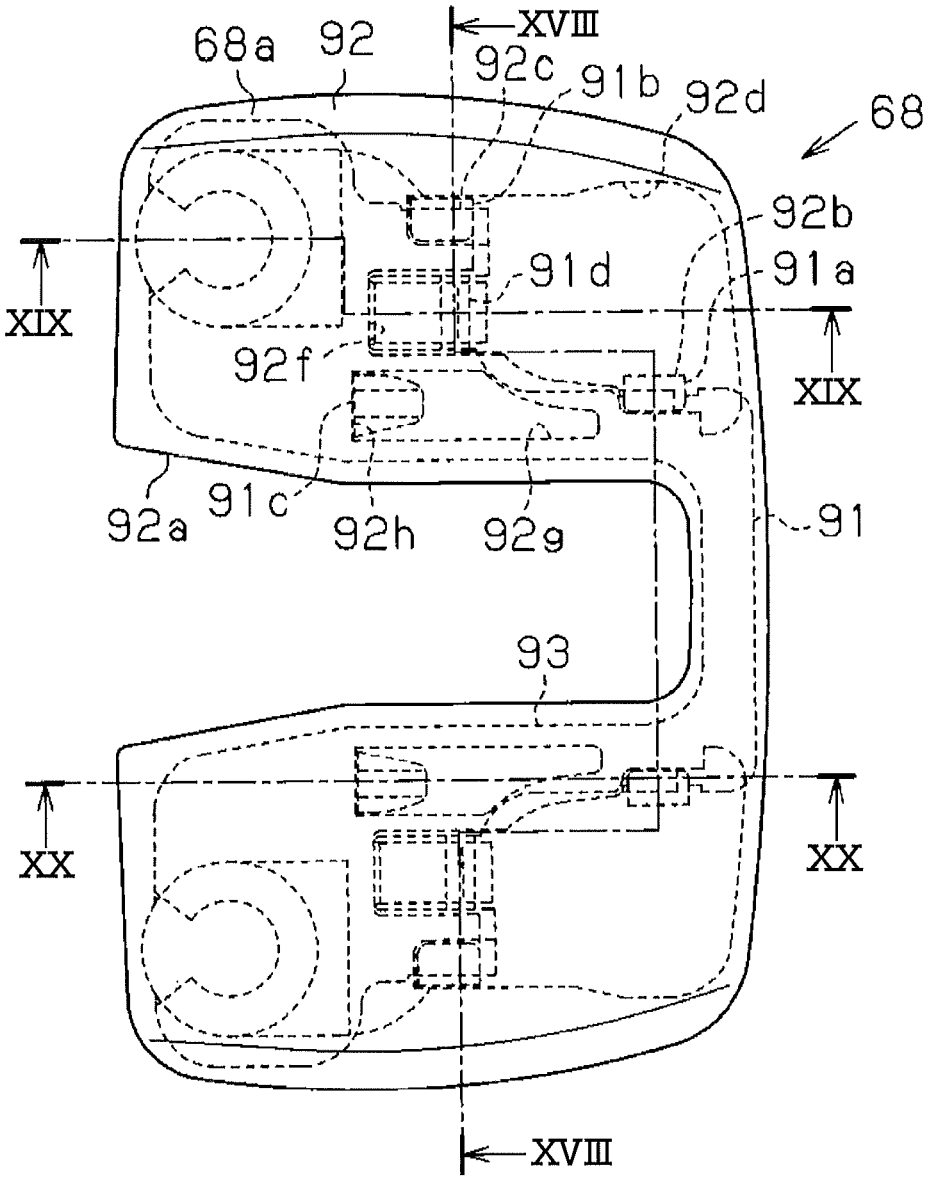
FIG. 17 is a plan view of the fixed wedge of the embodiment.
Figure 18:
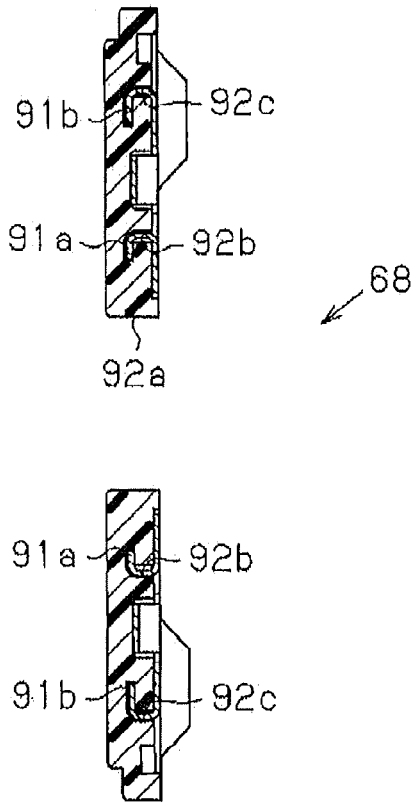
FIG. 18 is a cross-sectional view of the fixed wedge taken along line XVIII-XVIII in FIG. 17.

The wedge member 92 includes a slit 92*a* cut from the front direction of the fixed wedge 68 and is formed in a substantially U-shape. As illustrated in FIG. 17, the wedge member 92, which provides a design surface, that is, an aesthetically pleasing surface, of the fixed wedge 68, is removably secured to the attachment member 91 to cover an entire attachment member 91 at a side that faces the direction in which, for example, the guide rails 91*b*, 91*b* for the fixed wedge rise. As illustrated in FIG. 18, the wedge member 92 includes a pair of guide grooves 92*b*, 92*b* for the fixed wedge and a pair of guide grooves 92*c*, 92*c* for the fixed wedge, each of which includes a substantially L-shaped cross section. The pair of guide grooves 92*b*, 92*b* for the fixed wedge and the pair of guide grooves 92*c*, 92*c* for the fixed wedge respectively engage with the pair of guide rails 91*a*, 91*a* for the fixed wedge and the pair of guide rails 91*b*, 91*b* for the fixed wedge in a slidable manner. The pair of guide grooves 92*b*, 92*b* for the fixed wedge and the pair of guide grooves 92*c*, 92*c* of the wedge member 92 slidably engage with the pair of guide rails 91*a*, 91*a* for the fixed wedge and the pair of guide rails 91*b*, 91*b* for the fixed wedge of the attachment member 91, and thus the wedge member 92 is movable relative to the attachment member 91 in the front/rear direction of the fixed wedge 68 within a certain range. Accordingly, the wedge member 92 is guided to be attached to and removed from the attachment member 91.

Figure 19:
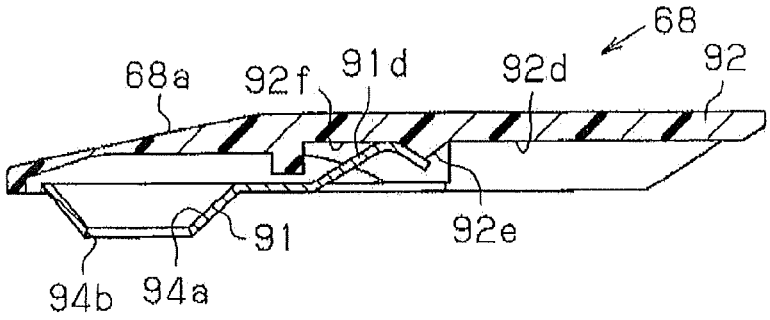
FIG. 19 is a cross-sectional view of the fixed wedge taken along line XIX-XIX in FIG. 17.

As illustrated in FIG. 19, in a state where the wedge member 92 is positioned at an attachment position relative to the attachment member 91, recessed portions 92*d*, 92*d* are formed at the wedge member 92. Each recessed portion 92*d* connects to a rear portion of the attachment member 91, the rear portion includes the engagement protruding portion 91*d*. Each recessed portion 92*d* includes a protruding portion 92*e* protrudingly formed to have a substantially triangular cross section and to be in pressure contact with a rear end of the corresponding engagement protruding portion 91*d*. The wedge member 92 includes engagement recessed portions 92*f*, 92*f* each defined by inner wall surfaces between the corresponding recessed portion 92*d* and the corresponding protruding portion 92*e*, including a front end surface of the recessed portion 92*d* and a front end surface of the protruding portion 92*e*.

When the wedge member 92 is moved in the rear direction of the fixed wedge 68 relative to the attachment member 91 and thus when the engagement protruding portion 91*d* is inserted into the recessed portion 92*d* from a rear end of the recessed portion 92*d*, the engagement protruding portion 91*d* becomes elastically deformed by the protruding portion 92*e* while fitting into the engagement recessed portion 92*f*. Thus, a movement of the wedge member 92 in the front/rear direction thereof (that is, the movement of the wedge member 92 in a sliding direction of the guide rails 91*a*, 91*a* for the fixed wedge, the guide rails 91*b*, 91*b* for the fixed wedge, and the guide grooves 92*b*, 92*b* for the fixed wedge, the guide grooves 92*c*, 92*c* for the fixed wedge) is restricted. In particular, the wedge member 92 is restricted from moving relative to the attachment member 91 in a direction in which the wedge member 92 is removed from the attachment member 91. In a state where the attachment member 91 and the wedge member 92 are attached to each other, when an external force that is equal to or greater than a certain level is applied to the wedge member 92 in the direction in which the wedge member 92 is removed from the attachment member 91, each engagement protruding portion 91*d*, which is elastically deformed by the corresponding protruding portion 92*e*, passes over the protruding portion 92*e* so as to come out of the corresponding engagement recessed portion 92*f*. Thus, the wedge member 92, which is attached to the attachment member 91, is removed from the attachment member 91.

Figure 20:
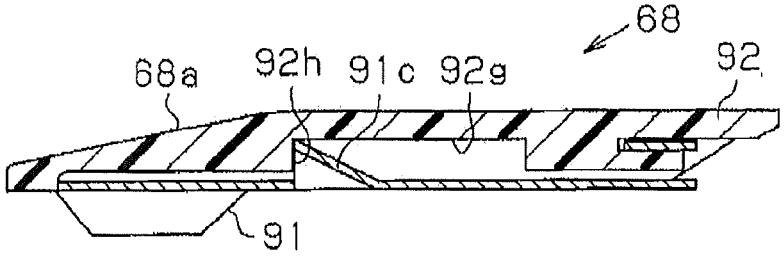
FIG. 20 is a cross-sectional view of the fixed wedge taken along line XX-XX in FIG. 17.

As illustrated in FIG. 20, the wedge member 92 is formed with recessed portions 92*g*, 92*g* each accommodating the corresponding first locking portion 91*c* when the wedge member 92 is positioned at the attachment position relative to the attachment member 91. A front end surface of each recessed portion 92*g* comes close to or comes in contact with a front end surface of the first locking portion 91*c* in the rear direction of the fixed wedge 68, that is, in a direction in which the wedge member 92 is brought to be attached to the attachment member 91 (i.e., an attachment direction), thereby providing a second locking portion 92*h*. Thus, in order to attach the wedge member 92 to the attachment member 91, when the wedge member 92 is moved relative to the attachment member 91 in the rear direction and comes to be positioned at the attachment position relative to the attachment member 91, the wedge member 92 is restricted from further moving in the rear direction relative to the attachment member 91, that is, in the attachment direction, because the second locking portion 92*h* engages with the first locking portion 91*c*. Accordingly, it is restricted that the wedge member 92 excessively moves in the attachment direction relative to the attachment member 91 beyond the intended attachment position.

As illustrated in FIGS. 19 and 20, the fixed wedge 68 includes an inclined surface 68*a* which is formed at a front portion of the wedge member 92 that is fixed to the attachment member 91. The inclined surface 68*a* is formed so as to be closer to the attachment member 91 in a thickness direction thereof.

In order to assemble the fixed wedge 68, the wedge member 92 is moved from a front direction to a rear direction of the attachment member 91 as illustrated in FIG. 16, while the guide rails 91*a*, 91*a* for the fixed wedge and the guide rails 91*b*, 91*b* for the fixed wedge which are formed at the attachment member 91 are slid along the guide grooves 92*b*, 92*b* for the fixed wedge and the guide grooves 92*c*, 92*c* for the fixed wedge which are provided at the wedge member 92, respectively as illustrated in FIG. 17. Further, the engagement protruding portions 91*d*, 91*d* of the attachment member 91 are slid into the recessed portions 92*d*, 92*d* of the wedge member 92 respectively, and thus the engagement protruding portions 91*d*, 91*d* are fitted into the engagement recessed portions 92*f*, 92*f*. Further, the first locking portions 91*c*, 91*c* of the attachment member 91 are slid in the recessed portions 92*g*, 92*g* of the wedge member 92 respectively, and the first locking portions 91*c*, 91*c* are brought closer to or come in contact with the second locking portions 92*h*, 92*h* in the attachment direction, respectively. Thus, the assembly of the fixed wedge 68 is completed.

Figure 21:
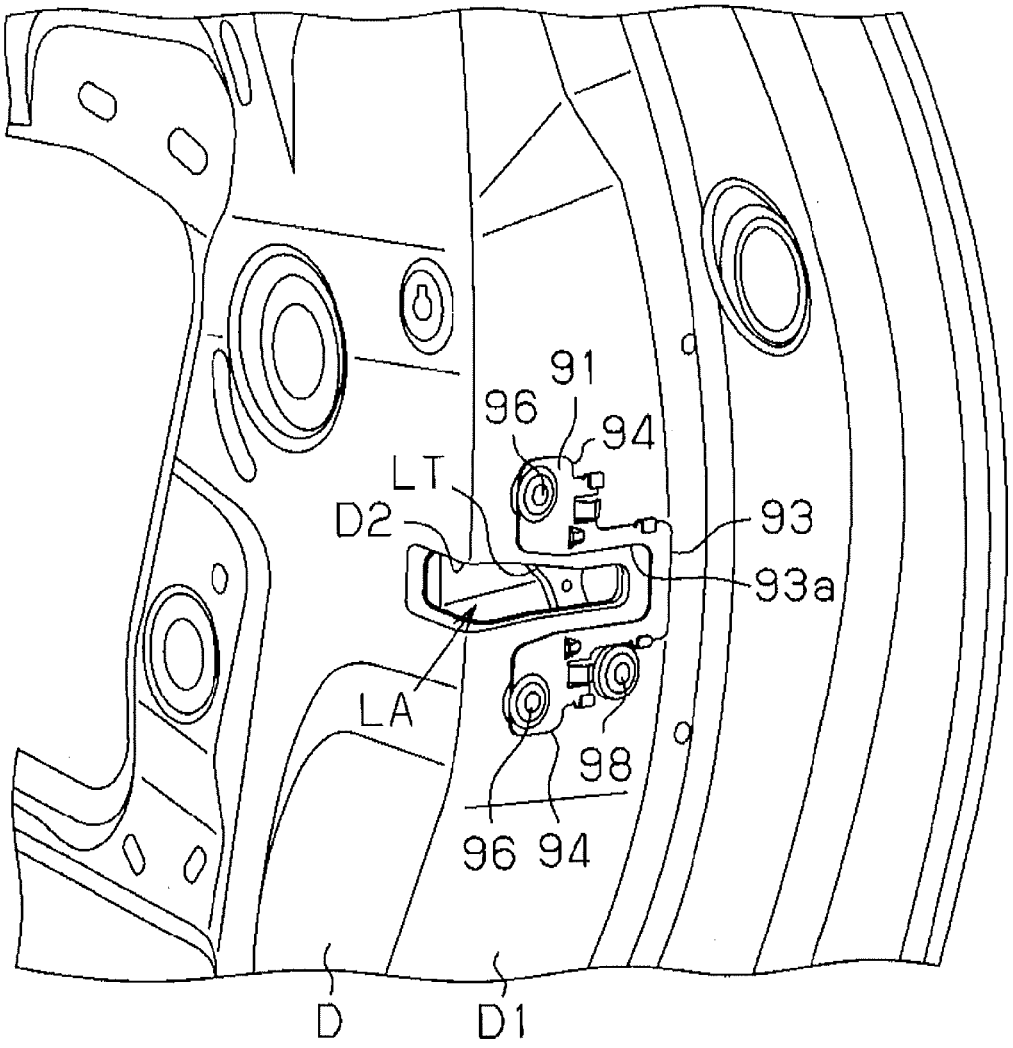
FIG. 21 is a perspective view illustrating a manner in which an attachment member of the fixed wedge of the embodiment is provided at the vehicle.
Figure 23:
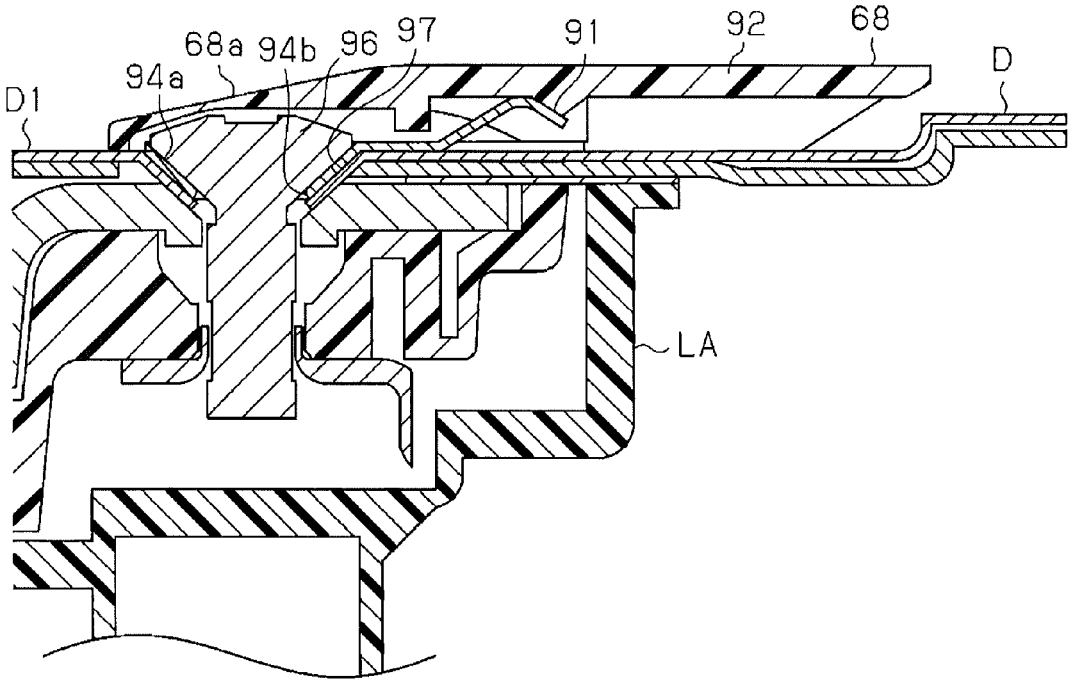
FIG. 23 is a cross-sectional view illustrating a manner in which the fixed wedge of the embodiment is assembled on a door panel.

In order to assemble the fixed wedge 68 on the door panel D (the end surface D1), first, the attachment member 91, without the wedge member 92 attached thereto, is fixedly attached to the end surface D1 as illustrated in FIG. 21. At this time, the attachment member 91 is attached to the door panel D together with the door lock assembly LA, which is temporarily attached to the door panel D at the opposite side relative to the attachment member 91. In other words, the door lock assembly LA is fastened in advance to the door panel D, at the opposite side relative to the attachment member 91, by means of a bolt 98 arranged so as not to interfere with the attachment member 91 (the fixed wedge 68). The attachment member 91 is fixedly attached to the end surface D1 together with the door lock assembly LA by means of bolts 96, 96. In a state where the attachment member 91 is attached to the end surface D1, the slit portion 93*a* of the attachment member 91 is arranged to surround a striker-receiving recess D2 provided at the door panel D for receiving therein the striker in a manner that a distance is left between the slit portion 93*a* and the striker-receiving recess D2. Specifically, the slit portion 93*a* is arranged to surround a portion of the striker-receiving recess D2, the portion which extends in the vehicle width direction. The striker-receiving recess D2 is provided so that the shaft 63 of the door lock striker 61 comes in and out of the striker-receiving recess D2. As illustrated in FIG. 23, each recessed portion 94*a* of the attachment member 91, which protrudes in a direction of the end surface D1, is configured to fit in a recessed portion 97 formed at the door panel D.

Figure 22:
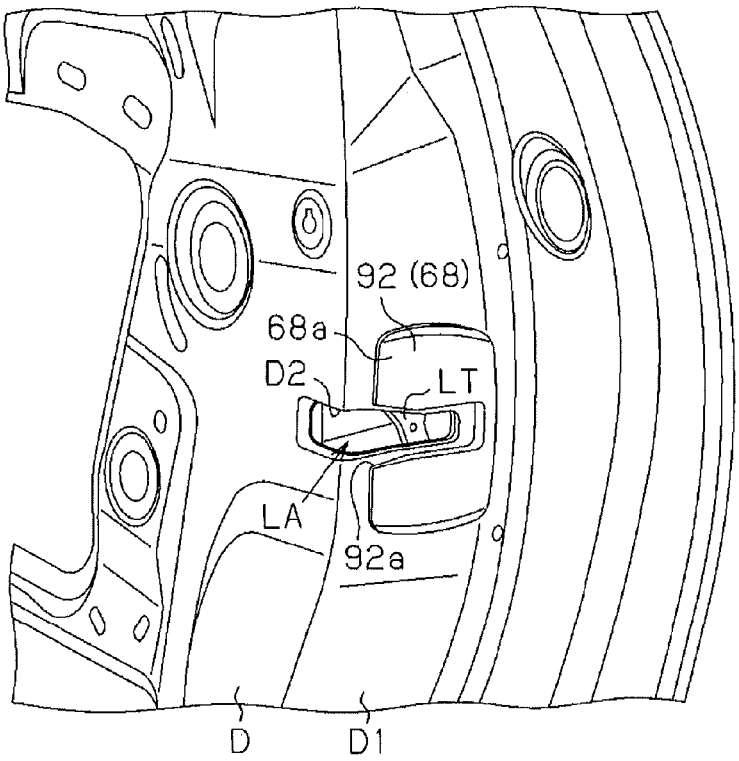
FIG. 22 is a perspective view illustrating a manner in which the fixed wedge of the embodiment is provided at the vehicle.

Next, the wedge member 92 is fixedly attached to the attachment member 91 that is secured to the end surface D1 as illustrated in FIG. 22 in the manner described above. At this time, the wedge member 92 covers the entire attachment member 91, and thus the attachment member 91 is not exposed to the outside. Accordingly, the bolts 96, 96 for fixing the attachment member 91 to the door panel D are not exposed to the outside at this time.

According to the fixed wedge 68 having the above-described configuration, as illustrated in FIGS. 1 and 22, in a state where the fixed wedge 68 is attached to the door panel D, a direction in which the slit 92*a* extends (that is, the front/rear direction of the fixed wedge 68) coincides with the advancing/receding direction of the door panel D relative to the vehicle body panel B when the vehicle door is operated for opening and closing (that is, the vehicle width direction in a state where the vehicle door is closed). Therefore, the slit 92*a* of the fixed wedge 68 (the wedge member 92) is formed in a shape that matches a shape of the portion of the striker-receiving recess D2 formed at the door panel D, the portion which extends in the vehicle width direction (the vehicle width direction in the state where the vehicle door is closed). In other words, due to the slit 92*a*, the fixed wedge 68 is configured to surround the striker-receiving recess D2 in a manner that the fixed wedge 68 is opened at a side facing the movable wedge device 60 in the advancing/receding direction of the door panel D relative to the vehicle body panel B. In addition, the inclined surface 68*a* is inclined so as to gradually come closer to the end surface D1 toward the direction in which the door panel D comes closer to the body panel B (toward the vehicle inside in the vehicle width direction) when the vehicle door is operated for closing the opening of the vehicle body.

According to the vehicle door fixing apparatus of the embodiment, the inclined surface 65*a* of the movable wedge 65 and the inclined surface 68*a* of the fixed wedge 68 (the wedge member 92) are in pressure contact with each other in a state where the vehicle door is closed as illustrated in FIG. 1.

Next, an operation of the vehicle door fixing apparatus of the aforementioned embodiment will be described. According to the vehicle door fixing apparatus of the embodiment, in a state where the vehicle door is closed, the inclined surface 65*a* of the movable wedge 65 provided at the vehicle body panel B in a reciprocatingly slidable manner is in contact with the inclined surface 68*a* of the fixed wedge 68 fixedly attached to the door panel D as illustrated in FIG. 1. At this time, the movable wedge 65 is pushed against the fixed wedge 68 by the biasing force of the spring 76, and thus the vehicle door is pushed toward a hinge of the vehicle door, and thus a backlash or a rattling of the vehicle door is restricted.

Figure 24:
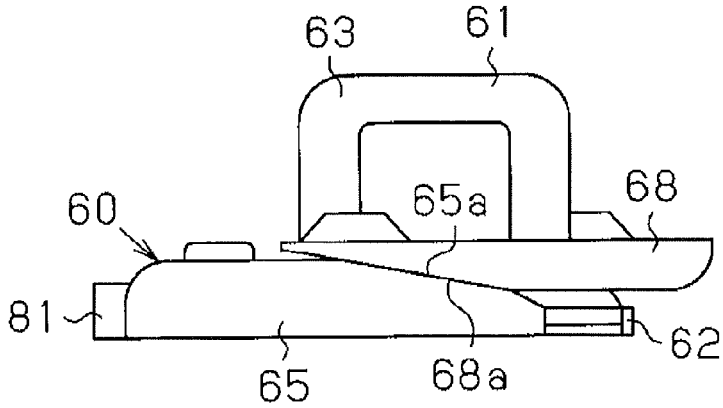
FIG. 24 is a lateral view illustrating a state of the movable wedge device and the fixed wedge of the vehicle door fixing apparatus of the embodiment when a vehicle body is not deformed.
Figure 25:
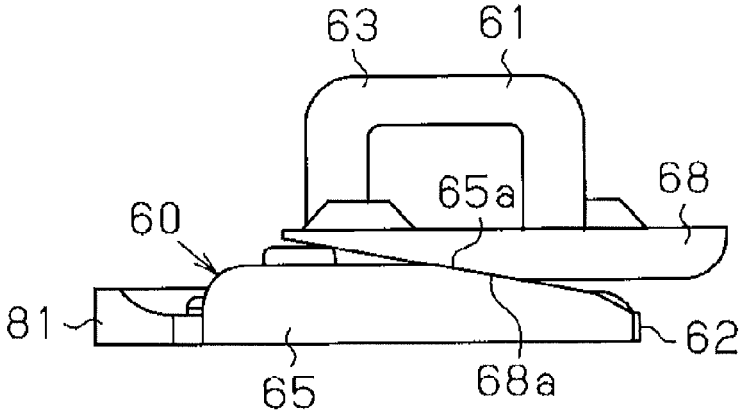
FIG. 25 is a lateral view illustrating a state of the movable wedge device and the fixed wedge of the vehicle door fixing apparatus of the embodiment when the vehicle body is deformed.
Figure 26:
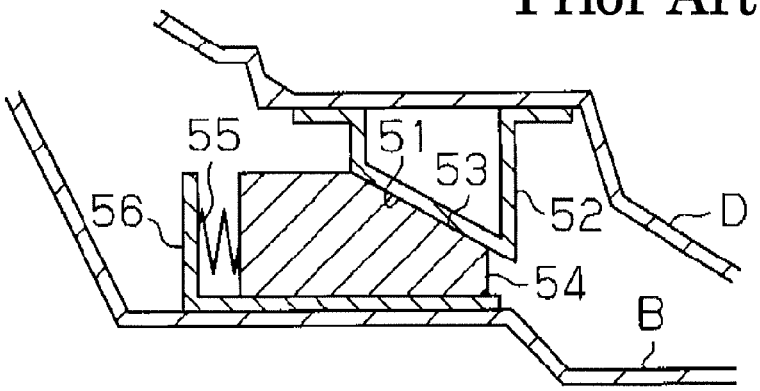
F I G. 26 Prior Art
FIG. 26 is a cross-sectional view of a known vehicle door fixing device.

In a case a bending deformation occurs to the vehicle body in the vehicle width direction (in the left/right direction of the vehicle), for example, when the vehicle makes a turn, the movable wedge 65 at a side of the vehicle at which the vehicle body expands moves relative to the fixed wedge 68 in the right direction when viewed in FIG. 24. At this time, the movable wedge 65 in a state illustrated in FIG. 24 moves to be in a state illustrated in FIG. 25. Thus, the fixed wedge 68 moves upward when viewed in FIG. 24 (that is, in a longitudinal direction (the front/rear direction) of the vehicle when the fixed wedge 68 is assembled on the vehicle). Consequently, a gap generated between an opening portion of the vehicle body and the vehicle door in the front/rear direction of the vehicle due to the bending deformation is reduced. As a result, in a case where the movable wedge 65 at the side of the vehicle at which the vehicle body shrinks moves relative to the fixed wedge 68, for example, when the vehicle makes another turn, the deformation of the vehicle body at the side of the vehicle at which the vehicle body shrinks may be restricted. Therefore, according to the vehicle door fixing apparatus having the configuration described in the embodiment, the backlash, ratting or vibrations of the vehicle door may be minimized and rigidity of the vehicle body may be effectively increased.

As explained above, according to the aforementioned embodiment, the following effects and advantages may be obtained. (1) According to the embodiment, the movable wedge 65 is configured to be attached to the body panel B together with the base plate 62 of the door lock striker 61, and the fixed wedge 68 is configured to be attached to the door panel D together with the door lock assembly LA. Thus, man-hours for assembly of the vehicle door fixing apparatus as a whole, including for example, the door lock striker 61, is reduced.

Specifically, the strength member 66 of the movable wedge 65, which surrounds the shaft 63 of the door lock striker 61 in a manner that the movable wedge 65 is opened at the side facing the fixed wedge 68 in the advancing/receding direction of the door panel D relative to the vehicle body panel B when the vehicle door is operated for opening and closing, is provided with the guide groove 66*a* at the above-mentioned side facing the fixed wedge 68. Accordingly, while the fixed wedge 68 receives a load from the contact members 67, 67 because of the pressure contact between the fixed wedge 68 and the contact members 67, 67, the strength member 66 may tend to elastically deform in a manner that an opening width of the guide groove 66*a* is increased (a so-called state where an opening portion is enlarged by a load applied thereto). However, because the strength member 66 has the higher rigidity than the contact members 67, 67, the elastic deformation of the strength member 66 is restricted, and therefore an operation of the movable wedge 65 is more stabilized.

(2) According to the embodiment, the chamfered portion 67*b* and the locking tab 67*c* of each contact member 67 retain in the sandwiching manner in the thickness direction of the strength member 66 a facing portion (the chamfered portion 66*e* and the locking portion 66*f*) of the strength member 66, which faces the contact members 67, 67 in the advancing/receding direction of the door panel D relative to the vehicle body panel B, thereby restricting each contact member 67 from disengaging from the strength member 66. In addition, each contact member 67 tends to relocate in a direction away from the fixed wedge 68 when coming into pressure contact with the fixed wedge 68. This relocation may increase an overlap width between the facing portion of the strength member 66 (the chamfered portion 66*e* and the locking portion 66*f*), and the chamfered portion 67*b* and the locking tab 67*c* both of which retains the facing portion in the sandwiching manner. Thus, each contact member 67 is restricted from disengaging from the strength member 66 by means of the pressure contact between the contact member 67 and the fixed wedge 68.

(3) According to the embodiment, each attachment protruding portion 67*a* is inserted in the corresponding attachment hole 66*d* and is restricted from disengaging from the attachment hole 66*d* in the thickness direction of the strength member 66, thereby restricting each contact member 67 from disengaging from the strength member 66.

(4) According to the embodiment, the wedge member 92 is removably attached to the attachment member 91. Thus, in a case that plural types of the wedge members 92, each of which has a different frictional engagement force relative to the movable wedge device 60 (the movable wedge 65), exist due to a change in a material or other reasons, one type of the wedge member 92 may be chosen from among the plural types of the wedge member 92 and be attached to the attachment member 91. Accordingly, a level of the frictional engagement between the wedge member 92 and the movable wedge device 60, that is, a level of fixation of the vehicle door, may be adjusted on the basis of user's preference. Alternatively, the frictional engagement of the wedge member 92 and the movable wedge device 60 may be released on the basis of user's preference by removing the wedge member 92 from the attachment member 91. In other words, by attaching or removing the wedge member 92 relative to the attachment member 91, a fixing effect of the vehicle door is selectively obtained.

In a case that plural types of the wedge members 92 each of which has a different aesthetic feature (for example, a color) exist, one type of the wedge member 92 may be chosen from among the plural types of the wedge member 92 and be attached to the attachment member 91. Thus, an aesthetic quality may be improved to meet user's preference.

In particular, the wedge member 92 may be attached to and removed from the attachment member 91 in a state where the attachment member 91 is attached to the end surface D1. Thus, replacement work of the wedge member 92 may be performed smoothly. (5) According to the embodiment, the wedge member 92 is guided to be attached to and removed from the attachment member 91 by means of an extremely simple structure where the guide grooves 92*b*, 92*b* for the fixed wedge and the guide grooves 92*c*, 92*c* for the fixed wedge slidably engage with the guide rails 91*a*, 91*a* for the fixed wedge and the guide rails 91*b*, 91*b* for the fixed wedge, respectively. Thus, attachment and removal work of the wedge member 92 may be performed smoothly.

(6) According to the embodiment, in a state where the attachment member 91 and the wedge member 92 are in the attachment position, each second locking portion 92*h* of the wedge member 92 comes closer to or comes in contact with the corresponding first locking portion 91*c* of the attachment member 91 in the direction in which the wedge member 92 is attached to the attachment member 91 (the rear direction of the fixed wedge 68). The direction in which the wedge member 92 is attached to the attachment member 91 matches the sliding direction of the guide grooves 92*b*, 92*b* for the fixed wedge and the guide grooves 92*c*, 92*c* for the fixed wedge relative to the guide rails 91*a*, 91*a* for the fixed wedge and the guide rails 91*b*, 91*b* for the fixed wedge. Thus, during the attachment work of the wedge member 92 to the attachment member 91, when the attachment member 91 and the wedge member 92 reach the attachment position, each second locking portion 92*h* engages with the corresponding first locking portion 91*c* in the attachment direction so that the wedge member 92 is restricted from further moving in the attachment direction. Thus, the wedge member 92 is restricted from excessively moving in the attachment direction relative to the attachment member 91 beyond the intended attachment position.

While the wedge member 92 is frictionally engaged with the movable wedge device 60 (the movable wedge 65), the wedge member 92 is restricted from moving relative to the attachment member 91 in the attachment direction, which coincides with a pressing direction of the movable wedge device 60. (7) According to the embodiment, when the attachment member 91 and the wedge member 92 are in the attachment position, the engagement protruding portions 91*d*, 91*d* of the attachment member 91 are fitted into the engagement recessed portions 92*f*, 92*f* of the wedge member 92. Thus, a movement of the wedge member 92 in the direction in which the wedge member 92 is removed from the attachment member 91 is blocked. Accordingly, when the attachment member 91 and the wedge member 92 are in the attachment position, the wedge member 92 is restricted from coming off the attachment member 91.

On the other hand, in a state where the attachment member 91 and the wedge member 92 are attached to each other, when the external force that is equal to or greater than the certain level is applied to the wedge member 92 in the direction in which the wedge member 92 is removed from the attachment member 91, the engagement protruding portion 91*d*, which is elastically deformed by the protruding portion 92*e*, passes over the protruding portion 92*e* so as to come out of the engagement recessed portion 92*f*. Thus, the wedge member 92, which is attached to the attachment member 91, may be removed from the attachment member 91.

(8) According to the embodiment, the attachment member 91 is attached to the door panel D by means of the bolts 96, 96, which also tighten the door lock assembly LA to the door panel D. Thus, there is no need to provide an attachment portion at the door panel D for exclusively attaching the attachment member 91 to the door panel D. Accordingly, even in case that the attachment member 91 (the fixed wedge 68) is attached to the door panel D after the door lock assembly LA is fastened to the door panel D, man-hours needed for attaching the attachment member 91 to the door panel D may be reduced.

(9) According to the embodiment, the spring 76 includes plural coil portions 76*a*, for example, the pair of coil portions 76*a*, 76*a* which are arranged in parallel to each other. Thus, an outer diameter of each coil portion 76*a* (a coil diameter) may be reduced compared to an outer diameter of each coil portion in a case where a biasing force having a necessary level is ensured by one coil portion. Accordingly, a size of the base plate 62 that includes the supporting portion 71*a* supporting the coil portions 76*a*, 76*a* (the cover 81) may be reduced in the moving direction of the movable wedge 65. Accordingly, the base plate 62 (the movable wedge device 60) of the embodiment may be mounted, without interfering with the flange B2, even on a vehicle at which the end surface B1 of the vehicle body panel B is reduced in the vehicle width direction (for example, a compact car), and thus a mountability of the base plate 62 is enhanced. As a result, the movable wedge device 60 (the vehicle door fixing apparatus) of the embodiment may be applied to various types of vehicles, thereby facilitating communization of the movable wedge device 60.

(10) According to the embodiment, the recessed portion 94*a*, which serves as the bearing surface for the corresponding bolt 96 for fixing the attachment member 91 to the door panel D, is formed at the attachment member 91 of the fixed wedge 68. According to this structure, the bearing surface for the bolt 96 is strengthened by using metal and thus a backlash at the fixed wedge 68, which would be otherwise caused by a creep deformation of the bearing surface made of, for example resin, for the bolt is adequately restricted.

(11) According to the embodiment, the recessed portion 94*a* of the fixed wedge 68, which serves as the bearing surface for the corresponding bolt 96, is formed to protrude toward the end surface D1 and fit in the recessed portion 97 formed at the door panel D. This may facilitate a position setting of the fixed wedge 68 relative to the door panel D when fixing the fixed wedge 68.

(12) According to the embodiment, the spring 76 is accommodated in the spring accommodating portion 71, and a part of the spring 76 and a vicinity of the spring 76 are covered with the cover 81, and thus a displacement of the spring 76 is controlled, and consequently, an inadequate posture change of the spring 76 is restricted. The cover 81 is formed separately from the base plate 62, thereby allowing the base plate 62 to be formed in a simple shape instead of a complicated shape while the inadequate posture change of the spring 76 is restricted. Consequently, according to the embodiment, the inadequate posture change of the spring 76 may be restricted adequately and deterioration in formability of the base plate 62 may be restricted.

(13) According to the embodiment, the base plate 62 is provided with the supporting portion 71*a* supporting the coil portions 76*a*, 76*a* at a portion of each coil portion 76*a*, the portion which is positioned opposite to the direction in which the pair of arm portions 76*b*, 76*b* protrudes. The base plate 62 is also provided with the cover 81 so that the cover 81 supports upper and lower portions of the coil portions 76*a*, 76*a* (when viewed in FIG. 3). Thus, the spring 76 may be held adequately.

(14) According to the embodiment, the step portion 72 is provided at the base plate 62 and the tab 83 engaging with the step portion 72 is provided at the cover 81. Thus, the cover 81 may be attached to and removed from the base plate 62 in a simple and reliable manner.

(15) According to the embodiment, the cover 81 is formed to cover end portions of the coil portions 76*a*, 76*a* of the spring 76. Thus, it may be prevented that the coil portions 76*a*, 76*a* of the spring 76 are in contact with and damages the vehicle body panel B.

(16) According to the embodiment, the movable wedge 65 may be assembled at the same time when the door lock striker 61 is assembled relative to the vehicle body panel B. The attachment member 91 (the fixed wedge 68) may be assembled at the same time when the door lock assembly LA is assembled relative to the door panel D. Thus, the man-hours for assembling the vehicle door fixing apparatus on the vehicle may be reduced, thereby improving a working performance for the assembly.

(17) According to the embodiment, the spring accommodating portion 71 is provided behind the door lock striker 61 in the moving direction of the movable wedge 65. Thus, the spring 76 may bias or push the movable wedge 65 evenly. In addition, according to the embodiment, the door lock striker 61 and the spring accommodating portion 71 are provided at the base plate 62, thereby making a forming operation simple.

Variations and changes may be made to the aforementioned embodiment as follows. According to the embodiment, the pair of guide rails 91*a*, 91*a* for the fixed wedge and the pair of guide rails 91*b*, 91*b* for the fixed wedge are provided at the attachment member 91 of the fixed wedge 68, and the pair of guide grooves 92*b*, 92*b* for the fixed wedge and the pair of guide grooves 92*c*, 92*c* for the fixed wedge are provided at the wedge member 92 of the fixed wedge 68. However, the guide grooves for the fixed wedge may be provided at the attachment member 91, and the guide rails for the fixed wedge may be provided at the wedge member 92. In addition, the number of pairs of the guide rails for the fixed wedge and the number of pairs of the guide grooves for the fixed wedge may be arbitrarily determined.

According to the embodiment, the engagement protruding portion 91*d* is provided at the attachment member 91 of the fixed wedge 68, and the engagement recessed portion 92*f* is provided at the wedge member 92. However, the engagement recessed portion may be provided at the attachment member 91 and the engagement protruding portion may be provided at the wedge member 92. The number of pairs of the engagement protruding portion and the engagement recessed portions may be arbitrarily determined.

In the embodiment, the number of the pair of first locking portions 91*c*, 91*c* of the attachment member 91 and the number of the pair of second locking portions 92*h*, 92*h* of the wedge member 92 may be arbitrarily determined. According to the embodiment, the number of the bolts for fixing the attachment member 91 may be arbitrarily determined. Further, the attachment member 91 may be fixed by means of another mounting member than the bolt (for example, a pin or a clip).

According to the aforementioned embodiment, the spring 76 may include one coil portion 76*a*, or three or more coil portions 76*a*. According to the embodiment, the strength member 66 of the movable wedge 65 may be made of resin as long as a sufficient rigidity (strength) is obtained. In addition, each contact member 67 may be made of metal provided that a sufficient buffering is ensured between the contact members 67, 67 and the wedge member 92 of the fixed wedge 68.

According to the embodiment, the attachment member 91 of the fixed wedge 68 may be made of resin as long as a sufficient rigidity (strength) is obtained. In addition, the wedge member 92, which defines the design surface, may be made of metal provided that a sufficient buffering is ensured between the wedge member 92 and, for example, the movable wedge 65.

According to the embodiment, the fixed wedge 68 (the attachment member 91) is fixedly attached to the door panel D by means of the bolts 96, 96. However, the fixed wedge 68 may be integrally provided at the door panel D. According to the embodiment, the contact member 67 is split into two pieces, that is, the pair of contact members 67, 67 is provided so that the contact members 67, 67 are arranged at both sides relative to the guide protruding portion 62*a* of the base plate 62. However, the contact member 67 may be formed into a single piece, that is, the contact members 67, 67 may be connected with each other behind the guide protruding portion 62*a*.

According to the embodiment, the end portion of the pin P of each contact member 67, which penetrates through the attachment hole 66*d* of the strength member 66, is welded to have the flanged shape, and thus the attachment protruding portion 67*a* is formed. Accordingly, each contact member 67 is fixedly attached to the strength member 66 without coming off or disengaging from the attachment hole 66*d*. However, for example, a clip may be used instead of the attachment protruding portion 67*a*.

In the embodiment, an elastic member may be disposed between a side surface of the guide rail 64 and a side wall of the guide groove 66*b* in a compressed state, in order to reduce a looseness between the guide rail 64 and the guide groove 66*b*, thereby restricting a backlash of the movable wedge 65.

In the embodiment, a locking member, which is configured to restrict the sliding movement of the movable wedge 65 and to lock the movable wedge 65 at a position where the movable wedge 65 causes the bolt holes 62*b*, 62*b* of the base plate 62 to be exposed, is removably attached so that a favorable assembly performance of the movable wedge device 60 is ensured.

According to the embodiment, each recessed portion 94*a* of the fixed wedge 68, which constitutes the bearing surface for the corresponding bolt 96, is provided to protrude in the direction of the end surface D1. However, in case, for example, the recessed portion 97 is not formed on the door panel D at the position at which the bolt is to be attached, the recessed portion 94*a* may be provided, for example, so as not to protrude in the direction of the end surface D1.

According to the embodiment, a surface of the inclined surface 65*a* of the movable wedge 65 (each contact member 67) may be coated with layers of an elastic material having higher elastic coefficient than elastic coefficient of the resin material forming the contact member 67, for example, silicone rubber but not limited thereto. Thus, even in case that the inclined surface 65*a* of the movable wedge 65 collides with the inclined surface 68*a* of the fixed wedge 68 when the vehicle door is closed, the elastic material may absorb the energy of an impact between the inclined surface 65*a* and the inclined surface 68*a*, and thus an occurrence of a high-volume abnormal noise may be restricted.

According to the embodiment, the cover 81 is formed to cover the lower portion of each coil portion 76*a* of the spring 76. However, the cover 81 may be formed so that the lower portion of each coil portion 76*a* is released, that is, the lower portion of the coil portion 76*a* is not covered, as long as the posture of the spring 76 is maintained adequately.

According to the embodiment, the cover 81 is structured to support both end portions of each coil portion 76*a* of the spring 76. However, the cover 81 may be structured to support one of the end portions (one of the end portion facing the protruding direction of the shaft 63 and the end position facing the opposite direction thereto) of each coil portion 76*a*.

According to the embodiment, the cover 81 is structured to be opened behind the coil portions 76*a*, 76*a* of the spring 76. However, the cover 81 may be structured to cover a rear portion of each coil portion 76*a*.

According to the embodiment, the step portion 72 is provided at the base plate 62 and the tab 83 engaging with the step portion 72 is provided at the cover 81. Thus, the cover 81 is fixed to the base plate 62. However, the cover 81 may be fixed to the base plate 62 in another manner.

According to the embodiment, the spring accommodating portion 71 is constituted by the hole formed at the base plate 62. However, in case that, for example, a spring of another type than the coil spring is used, the spring accommodating portion 71 may include, for example, a recessed configuration or a polygonal configuration as long as the accommodating portion accommodating the spring and the supporting portion supporting the spring when the spring biases the movable wedge are provided.

According to the embodiment, the movable wedge 65 is biased by the spring 76. The configuration of the spring 76 is not limited to that illustrated in, for example, FIG. 3 and appropriate variations and changes may be made. In addition, another elastic member than the spring may be used for biasing the movable wedge 65.

According to the embodiment, each of the inclined surface 65*a* of the movable wedge 65 and the inclined surface 68*a* of the fixed wedge 68 is formed in a flat surface not including steps, however, each of the inclined surfaces 65*a*, 68*a* may be formed stepwise or in a curved surface.

According to the embodiment, the fixed wedge 68 is fixedly attached to the door panel D by means of the bolts 96, 96. However, the fixed wedge may be integrally provided at the door panel D. According to the embodiment, the movable wedge 65 is provided at a same side at which the door lock striker 61 is provided, and the fixed wedge 68 is provided at a same side at which the door lock assembly LA is provided. However, the fixed wedge 68 may be provided at the same side at which the door lock striker 61 is provided and the movable wedge 65 may be provided at the side at which the door lock assembly LA is provided. In this case, the strength member 66 of the movable wedge 65 is arranged so as to surround the striker-receiving recess D2 in a manner that the guide groove 66*a* is opened toward the fixed wedge 68 in the advancing/receding direction of the door panel D relative to the vehicle body panel B.

According to the embodiment, the movable wedge 65 is provided at the vehicle body panel B and the fixed wedge 68 is provided at the door panel D, however, the movable wedge 65 may be provided at the door panel D and the fixed wedge 68 may be provided at the vehicle body panel B. In this case, the fixed wedge 68 may be integrally provided at the base plate 62 of the door lock striker 61 or may be integrally provided at the vehicle body panel B.

According to the embodiment, the embodiment is employed in the side door of the vehicle having the structure of the fully-open air car or in the vehicle having the structure of the convertible vehicle (that is, the vehicle provided with a roof that opens and closes, or with a removable roof). However, the embodiment may be employed in other doors for opening and closing the opening portion provided at the vehicle body, including but not limited to, a side door of a vehicle having a fixed roof, a sliding-type side door for sliding in the front/rear direction of the vehicle, a back door (a rear gate) for tilting in an up/down direction or the left/right direction of the vehicle to open and close the opening portion provided at a rear portion of the vehicle body.

According to the aforementioned embodiment, the vehicle door fixing apparatus includes the fixed wedge 68 configured to be provided at one of the vehicle body panel B and a door panel D, and the movable wedge 65 configured to be provided at the other one of the vehicle body panel B and the door panel D to be movable in the advancing/receding direction of the door panel D relative to the vehicle body panel B, wherein the movable wedge 65 is configured to be assembled on the other one of the vehicle body panel B and the door panel D together with the base plate 62 of the door lock striker 61 or with the door lock assembly LA that is engageable with the shaft 63 of the door lock striker 61, the movable wedge 65 includes the strength member 66 that is configured to surround the striker-receiving recess D2 provided, for receiving therein the shaft 63 of the door lock striker 61, at the vehicle body panel B or at the door panel D any one of which the door lock assembly LA is assembled on, in a manner that the strength member 66 is opened at the side facing the fixed wedge 68 in the advancing/receding direction, or that is configured to surround the shaft 63 of the door lock striker 61 in the manner that the strength member 66 is opened at the side facing the fixed wedge 68 in the advancing/receding direction, the movable wedge 65 includes the contact member 67 fixedly attached to the strength member 66 and configured to be in pressure contact with the fixed wedge 68, and the strength member 66 includes the rigidity that is higher than the rigidity of the contact member 67.

According to the above described structure, at least the movable wedge 65 is assembled on the vehicle body panel B or on the door panel D together with one or the other one of the base plate 62 of the door lock striker 61 and the door lock assembly LA. Thus, the man-hours for the assembly, including, for example, the door lock striker 61, as a whole may be reduced.

Specifically, the strength member 66, which surrounds the shaft 63 or the striker-receiving recess D2 in a manner that the strength member 66 is opened at the side facing the fixed wedge 68 in the advancing/receding direction of the door panel D relative to the vehicle body panel B, includes the guide groove 66*a*. Thus, while the fixed wedge 68 receives the load from the contact members 67, 67 because of the pressure contact between the fixed wedge 68 and the contact members 67, 67, the strength member 66 will elastically deform in a manner that the opening width of the guide groove 66*a* is increased (the so-called state where an opening portion is enlarged by a load applied thereto). However, because the strength member 66 has the higher rigidity than the contact members 67, 67, the elastic deformation of the strength member 66 is restricted, and therefore the operation of the movable wedge 65 is more stabilized.

According to the above described structure, the vehicle door fixing apparatus of which assembly man-hours is reduced as a whole is provided.

According to the aforementioned embodiment, the vehicle door fixing apparatus includes the fixed wedge 68 configured to be fixed at one of the vehicle body panel B and the door panel D, and the movable wedge 65 configured to be provided at the other one of the vehicle body panel B and the door panel D to be movable in the advancing/receding direction of the door panel D relative to the vehicle body panel B, wherein the fixed wedge 68 is configured to be assembled on one of the vehicle body panel B and the door panel D together with one of the base plate 62 of the door lock striker 61 and the door lock assembly LA that is engageable with the shaft 63 of the door lock striker 61, the movable wedge 65 is configured to be assembled on the other one of the vehicle body panel B and the door panel D together with the other one of the base plate 62 and the door lock assembly LA, the movable wedge 65 includes the strength member 66 that is configured to surround the striker-receiving recess D2 provided, for receiving therein the shaft 63 of the door lock striker 61, at the vehicle body panel B or at the door panel D any one of which the door lock assembly LA is assembled on, in a manner that the strength member 66 is opened at the side facing the fixed wedge 68 in the advancing/receding direction, or that is configured to surround the shaft 63 of the door lock striker 61 in the manner that the strength member 66 is opened at the side facing the fixed wedge 68 in the advancing/receding direction, the movable wedge 65 includes the contact member 67 fixedly attached to the strength member 66 and configured to be in pressure contact with the fixed wedge 68, and the strength member 66 includes the rigidity that is higher than the rigidity of the contact member 67.

According to the above described structure, each of the fixed wedge 68 and the movable wedge 65 is assembled on the vehicle body panel B or on the door panel D together with one or the other one of the base plate 62 of the door lock striker 61 and the door lock assembly LA. Thus, the man-hours for the assembly, including, for example, the door lock striker 61, as a whole may be reduced.

Specifically, the strength member 66, which surrounds the shaft 63 or the striker-receiving recess D2 in a manner that the strength member 66 is opened at the side facing the fixed wedge 68 in the advancing/receding direction of the door panel D relative to the vehicle body panel B, includes the guide groove 66*a*. Thus, while the fixed wedge 68 receives the load from the contact members 67, 67 because of the pressure contact between the fixed wedge 68 and the contact members 67, 67, the strength member 66 will elastically deform in a manner that the opening width of the guide groove 66*a* is increased (the so-called state where an opening portion is enlarged by a load applied thereto). However, because the strength member 66 has the higher rigidity than the contact members 67, 67, the elastic deformation of the strength member 66 is restricted, and therefore the operation of the movable wedge 65 is more stabilized.

According to the aforementioned embodiment, the contact member 67 includes the chamfered portion 67*b* and the locking tab 67*c* each preventing the contact member 67 from disengaging from the strength member 66.

According to the above described structure, the chamfered portion 67*b* and the locking tab 67*c* prevent the contact members 67, 67 from disengaging from the strength member 66.

According to the aforementioned embodiment, the chamfered portion 67*b* and the locking tab 67*c* are formed at the end portion, which is away from the fixed wedge 68 in the advancing/receding direction of the door panel D relative to the vehicle body panel B, of the contact member 67 and the chamfered portion 67*b* and the locking tab 67*c* retain, in the sandwiching manner in the thickness direction of the strength member 66, the facing portion of the strength member 66 which faces the chamfered portion 67*b* and the locking tab 67*c* in the advancing/receding direction of the door panel D relative to the vehicle body panel B.

According to the above described structure, the chamfered portion 67*b* and the locking tab 67*c* retain, in the sandwiching manner, in the thickness direction of the strength member 66, the facing portion of the strength member 66 facing the chamfered portion 67*b* and the locking tab 67*c* in the advancing/receding direction of the door panel D relative to the vehicle body panel B, thereby restricting the contact members 67, 67 from coming off or disengaging from the strength member 66. In addition, the contact members 67, 67 are configured to relocate in a direction away from the fixed wedge 68 when coming into pressure contact with the fixed wedge 68. This relocation may increase the overlap width between the facing portion of the strength member 66 the chamfered portion 66*e* and the locking portion 66*f*, and the chamfered portion 67*b* and the locking tab 67*c* which retain, in the sandwiching manner, the facing portion of the strength member 66. Thus, the contact members 67, 67 are restricted from coming off or disengaging from the strength member 66 by means of the pressure contact between the contact members 67, 67 and the fixed wedge 68.

According to the aforementioned embodiment, the strength member 66 includes the attachment hole 66*d* penetrating the strength member 66 in the thickness direction of the strength member 66, and the contact member 67 includes the attachment protruding portion 67*a* protruding from the contact member 67 and preventing the contact member 67 from disengaging from the strength member 66 in the thickness direction of the strength member 66 by being inserted in the attachment hole 66*d*.

According to the above described structure, the attachment protruding portion 67*a* is inserted in each attachment hole 66*d* and thus each contact member is prevented from coming off the strength member 66 in the thickness direction of the strength member 66, thereby restricting the contact members 67, 67 from disengaging from the strength member 66.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicle door fixing apparatus, comprising:

a fixed wedge configured to be provided at one of a vehicle body panel and a door panel;

a movable wedge configured to be provided at the other one of the vehicle body panel and the door panel to be movable in an advancing/receding direction of the door panel relative to the vehicle body panel;

wherein the movable wedge is configured to be assembled on said the other one of the vehicle body panel and the door panel together with a base plate of a door lock striker or with a door lock assembly that is engageable with a shaft of the door lock striker;

the movable wedge includes a strength member that is configured to surround a striker-receiving recess provided, for receiving therein the shaft of the door lock striker, at the vehicle body panel or at the door panel any one of which the door lock assembly is assembled on, in a manner that the strength member is opened at a side facing the fixed wedge in the advancing/receding direction, or that is configured to surround the shaft of the door lock striker in the manner that the strength member is opened at the side facing the fixed wedge in the advancing/receding direction;

the movable wedge includes a contact member fixedly attached to the strength member so that the contact member is fixed in position relative to the strength member and configured to be in pressure contact with the fixed wedge;

the strength member and the contact member are made of different materials, the strength member possessing a rigidity that is higher than a rigidity of the contact member; and the movable wedge is slidably mounted on the base plate of the door lock striker so that the contact member and the strength member are slidable together as a unit relative to the base plate.

2. The vehicle door fixing apparatus according to claim 1, wherein the contact member includes a disengagement-prevention portion preventing the contact member from disengaging from the strength member.

3. The vehicle door fixing apparatus according to claim 2, wherein the disengagement-prevention portion is formed at an end portion, which is away from the fixed wedge in the advancing/receding direction of the door panel relative to the vehicle body panel, of the contact member and the disengagement-prevention portion retains, in a sandwiching manner in a thickness direction of the strength member, a facing portion of the strength member which faces the disengagement-prevention portion in the advancing/receding direction of the door panel relative to the vehicle body panel.

4. The vehicle door fixing apparatus according to claim 3, wherein the strength member includes an attachment hole penetrating the strength member in the thickness direction of the strength member, and the contact member includes a disengagement-prevention protruding portion protruding from the contact member and preventing the contact member from disengaging from the strength member in the thickness direction of the strength member by being inserted in the attachment hole.

5. The vehicle door fixing apparatus according to claim 2, wherein the strength member includes an attachment hole penetrating the strength member in the thickness direction of the strength member, and the contact member includes a disengagement-prevention protruding portion protruding from the contact member and preventing the contact member from disengaging from the strength member in the thickness direction of the strength member by being inserted in the attachment hole.

6. The vehicle door fixing apparatus according to claim 1, wherein the strength member includes an attachment hole penetrating the strength member in the thickness direction of the strength member, and the contact member includes a disengagement-prevention protruding portion protruding from the contact member and preventing the contact member from disengaging from the strength member in the thickness direction of the strength member by being inserted in the attachment hole.

7. The vehicle door fixing apparatus according to claim 1, wherein the strength member includes a guide groove extending in a front/rear direction of the movable wedge, and the shaft projects upwardly away from the base plate and is positioned in the guide groove of the strength member.

8. The vehicle door fixing apparatus according to claim 7, further comprising a spring which applies a biasing force to the movable wedge to urge both the contact member and the strength member in the front direction in which the shaft is positioned in the guide groove.

9. A vehicle door fixing apparatus, comprising:

a fixed wedge configured to be fixed at one of a vehicle body panel and a door panel;

a movable wedge configured to be provided at the other one of the vehicle body panel and the door panel to be movable in an advancing/receding direction of the door panel relative to the vehicle body panel;

wherein the fixed wedge is configured to be assembled on said one of the vehicle body panel and the door panel together with one of a base plate of a door lock striker and a door lock assembly that is engageable with a shaft of the door lock striker;

the movable wedge is configured to be assembled on said the other one of the vehicle body panel and the door panel together with the other one of the base plate and the door lock assembly;

the movable wedge includes a strength member that is configured to surround a striker-receiving recess provided, for receiving therein the shaft of the door lock striker, at the vehicle body panel or at the door panel any one of which the door lock assembly is assembled on, in a manner that the strength member is opened at a side facing the fixed wedge in the advancing/receding direction, or that is configured to surround the shaft of the door lock striker in the manner that the strength member is opened at the side facing the fixed wedge in the advancing/receding direction;

the movable wedge includes a contact member fixedly attached to the strength member so that the contact member is fixed in position relative to the strength member and configured to be in pressure contact with the fixed wedge;

the strength member and the contact member are made of different materials, the strength member possessing a rigidity that is higher than a rigidity of the contact member; and the movable wedge is slidably mounted on the base plate of the door lock striker so that the contact member and the strength member are slidable together as a unit relative to the base plate.

10. The vehicle door fixing apparatus according to claim 9, wherein the contact member includes a disengagement-prevention portion preventing the contact member from disengaging from the strength member.

11. The vehicle door fixing apparatus according to claim 10, wherein the disengagement-prevention portion is formed at an end portion, which is away from the fixed wedge in the advancing/receding direction of the door panel relative to the vehicle body panel, of the contact member and the disengagement-prevention portion retains, in a sandwiching manner in a thickness direction of the strength member, a facing portion of the strength member which faces the disengagement-prevention portion in the advancing/receding direction of the door panel relative to the vehicle body panel.

12. The vehicle door fixing apparatus according to claim 11, wherein the strength member includes an attachment hole penetrating the strength member in the thickness direction of the strength member, and the contact member includes a disengagement-prevention protruding portion protruding from the contact member and preventing the contact member from disengaging from the strength member in the thickness direction of the strength member by being inserted in the attachment hole.

13. The vehicle door fixing apparatus according to claim 10, wherein the strength member includes an attachment hole penetrating the strength member in the thickness direction of the strength member, and the contact member includes a disengagement-prevention protruding portion protruding from the contact member and preventing the contact member from disengaging from the strength member in the thickness direction of the strength member by being inserted in the attachment hole.

14. The vehicle door fixing apparatus according to claim 9, wherein the strength member includes an attachment hole penetrating the strength member in the thickness direction of the strength member, and the contact member includes a disengagement-prevention protruding portion protruding from the contact member and preventing the contact member from disengaging from the strength member in the thickness direction of the strength member by being inserted in the attachment hole.

15. The vehicle door fixing apparatus according to claim 9, further comprising a spring which applies a biasing force to the contact member and the strength member together as a unit.

16. The vehicle door fixing apparatus according to claim 9, wherein the strength member includes a guide groove extending in a front/rear direction of the movable wedge, and the shaft projects upwardly away from the base plate and is positioned in the guide groove of the strength member.

17. The vehicle door fixing apparatus according to claim 16, further comprising a spring which applies a biasing force to the movable wedge to urge both the contact member and the strength member in the front direction in which the shaft is positioned in the guide groove.

18. A vehicle door fixing apparatus comprising:

a spring which applies a biasing force to the contact member and the strength member together as a unit;

a fixed wedge configured to be provided at one of a vehicle body panel and a door panel;

a movable wedge configured to be provided at the other one of the vehicle body panel and the door panel to be movable in an advancing/receding direction of the door panel relative to the vehicle body panel;

wherein the movable wedge is configured to be assembled on said the other one of the vehicle body panel and the door panel together with a base plate of a door lock striker or with a door lock assembly that is engageable with a shaft of the door lock striker;

the movable wedge includes a strength member that is configured to surround a striker-receiving recess provided, for receiving therein the shaft of the door lock striker, at the vehicle body panel or at the door panel any one of which the door lock assembly is assembled on, in a manner that the strength member is opened at a side facing the fixed wedge in the advancing/receding direction, or that is configured to surround the shaft of the door lock striker in the manner that the strength member is opened at the side facing the fixed wedge in the advancing/receding direction;

the movable wedge includes a contact member fixedly attached to the strength member so that the contact member is fixed in position relative to the strength member and configured to be in pressure contact with the fixed wedge; and the strength member and the contact member are made of different materials, the strength member possessing a rigidity that is higher than a rigidity of the contact member.

* * * * *